US008900784B2

(12) United States Patent
Katano et al.

(10) Patent No.: US 8,900,784 B2
(45) Date of Patent: Dec. 2, 2014

(54) TONER, DEVELOPER, TONER CONTAINER, IMAGE FORMING APPARATUS, IMAGE FORMING METHOD, AND PROCESS CARTRIDGE

(75) Inventors: Yasuo Katano, Kanagawa (JP); Yukimichi Someya, Saitama (JP); Shinji Tezuka, Kanagawa (JP); Fuminari Kaneko, Tokyo (JP); Kohji Takeuchi, Kanagawa (JP); Kohji Matsuoka, Kanagawa (JP); Takuma Nakamura, Kanagawa (JP); Tsuneo Kurotori, Tokyo (JP); Hidekazu Yaginuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 81 days.

(21) Appl. No.: 13/470,490

(22) Filed: May 14, 2012

(65) Prior Publication Data

US 2012/0295192 A1 Nov. 22, 2012

(30) Foreign Application Priority Data

May 20, 2011 (JP) ..... 2011-113897
Feb. 8, 2012 (JP) ..... 2012-025295

(51) Int. Cl.
*G03G 9/087* (2006.01)
*G03G 9/097* (2006.01)
*G03G 9/08* (2006.01)

(52) U.S. Cl.
CPC ..... *G03G 9/08795* (2013.01); *G03G 9/09775* (2013.01); *G03G 9/0825* (2013.01); *G03G 9/0812* (2013.01); *G03G 9/08786* (2013.01); *G03G 9/097* (2013.01); *G03G 9/08788* (2013.01); *G03G 9/08782* (2013.01); *G03G 9/08797* (2013.01)
USPC ..... 430/108.1; 430/108.4; 430/109.3; 430/110.1

(58) Field of Classification Search
USPC ..... 430/109.3, 110.1, 108.1, 108.4; 399/252
See application file for complete search history.

(56) References Cited

U.S. PATENT DOCUMENTS

| | | | | |
|---|---|---|---|---|
| 2006/0045571 | A1* | 3/2006 | Matsuura et al. | 399/149 |
| 2007/0134582 | A1* | 6/2007 | Moriya | 430/109.3 |
| 2009/0297975 | A1 | 12/2009 | Ishikawa et al. | |
| 2010/0047706 | A1 | 2/2010 | Matsumura et al. | |

FOREIGN PATENT DOCUMENTS

| | | | |
|---|---|---|---|
| CN | 1938650 | | 3/2007 |
| CN | 101655674 | | 2/2010 |
| EP | 1734413 | A1 | 12/2006 |
| JP | 2002-88678 | | 3/2002 |
| JP | 2002-97444 | | 4/2002 |
| JP | 2002-97445 | | 4/2002 |
| JP | 2002-221823 | | 8/2002 |
| JP | 2004-258429 | | 9/2004 |
| JP | 2004-347893 | | 12/2004 |
| JP | 2007-121562 | | 5/2007 |
| JP | 4089860 | | 3/2008 |
| JP | 4365347 | | 8/2009 |
| JP | 2010-85841 | | 4/2010 |

OTHER PUBLICATIONS

Grant, R. et al., ed., Grant & Hackh's Chemical Dictionary, fifth edition, McGraw-Hill Book Company, NY (1987), pp. xii and 552.*
European search report dated Aug. 22, 2012 in connection with corresponding European patent application No. 12168407.0.
Chinese official action dated Nov. 28, 2013 and English translation in corresponding Chinese patent application No. 2012 10 27 3585.5.

* cited by examiner

*Primary Examiner* — Janis L Dote
(74) *Attorney, Agent, or Firm* — Cooper & Dunham LLP

(57) ABSTRACT

To provide a toner which contains a binder resin, a colorant, and capsules, wherein the binder resin contains a thermoplastic elastomer, and wherein the capsules each encapsulate a plasticizer capable of softening the thermoplastic elastomer and the capsules are fractured upon application of predetermined pressure.

6 Claims, 7 Drawing Sheets

TONER, DEVELOPER, TONER CONTAINER, IMAGE FORMING APPARATUS, IMAGE FORMING METHOD, AND PROCESS CARTRIDGE

BACKGROUND OF THE INVENTION

1. Field of the Invention

The present invention relates to a toner, and to a developer, toner container, image forming apparatus, image forming method, and process cartridge, all of which uses the toner.

2. Description of the Related Art

Conventionally, in an electrophotographic image forming apparatus or the like, an electrically or magnetically formed latent image is visualized with a toner. For example, in electrophotography, a latent electrostatic image (latent image) is formed on a photoconductor, followed by developing the latent image with the toner, to form a toner image. The toner image is typically transferred onto a transfer material (a recording medium) such as paper, followed by fixing onto the recording medium.

In the fixing image for fixing the toner image on the recording medium, a thermal fixing system, such as a heating roller fixing system or heating belt fixing system, has been generally widely used in the conventional art, because of its excellent energy efficiency.

Recently, there are increasing demands from the market for image forming apparatuses of high speed and energy saving, and therefore a toner having excellent fixing ability at the low temperature close to ordinary temperature (referred to merely as "low temperature" hereinafter) and capable of providing high quality images is desired.

A thermal fixing system, such as a heat roller fixing system and heat belt fixing system, has however not satisfied these demands, especially, energy saving.

In order to achieve low temperature fixing ability of a toner, there is, for example, a method of lowering a softening point of a binder resin.

The binder resin of a low softening point, however, reduces thermal resistance of the resulting toner, which may cause a problem of so-called "blocking" that is a phenomenon that the toner particles are fused each other especially in high temperature environments. In addition, there are also a problem that the toner is fused to and stains the interior of a developing unit and to a carrier in a developing unit (a problem of toner-spent), and a problem that the toner tends to cause filming on a surface of a photoconductor (a problem of toner-filming).

Moreover, there is disclosed a technique in which a toner contains a binder resin and a plasticizer of the binder resin to reduce a glass transition temperature Tg of the toner, which enables to perform fixing at the heating temperature lower than conventional heating temperature (see Japanese Patent Application Laid-Open (JP-A) No. 2006-330392).

However, there is a possibility that an internal temperature of a developing unit may become close to 50° C. If the Tg of the toner is reduced to about 40° C. to about 50° C. using the plasticizer as in the proposed technique, there are problems that the toner-spent and toner-filming may occur as in the case of the binder resin of low softening temperature. Accordingly, it is difficult to achieve the fixing of the toner at low temperature of about 60° C., which is close to ordinary temperature, without causing toner-spent and toner-filming, merely by adding the plasticizer to the toner. Even when the fixing temperature of the fixing unit is set to 60° C., the temperature of the toner becomes about 40° C. to about 50° C. due to heat loss to the recording medium.

Further, there is disclosed a technique in which a toner contains cyclic rubber having elasticity, and wax that is a plasticizer of the cyclic rubber (see JP-A No. 2002-221825). The disclosed art aims to achieve heat resistant storage stability and hot offset resistance of a toner as well as achieving low temperature softening of the toner.

This technique however has a problem that both toner-spent and toner-filming cannot be prevented when fixing is performed at low temperature, about 60° C.

As a technique related to an adhesive label, there is disclosed a so-called delayed tack-system adhesive label, in which an adhesive layer contains a thermoplastic resin of high Tg and a solid plasticizer at ordinary temperature, and the adhesive layer does not exhibit tackiness unless heated, and exhibits tackiness as the solid plasticizer is melted upon heating to soften the thermoplastic resin (see JP-A No. 2002-88678). It may be possible to apply this technique to achieve low temperature fixing of a toner. If the temperature at which the solid plasticizer is melted is set to about 40° C. to about 50° C., however, there is a problem that the solid plasticizer is melted in a developing unit those temperature becomes about 50° C. to thereby cause toner-spent.

Similarly to the above, there is disclosed, as a technique related to an adhesive label, a technique related to a thermosensitive delayed tack adhesive, in which an adhesive layer contains a thermoplastic resin and microcapsules each encapsulating a liquid plasticizer, and the liquid plasticizer bleeds out upon fracture of the microcapsules and the bled liquid plasticizer softens the thermoplastic resin to thereby make the adhesive layer tacky (see JP-A No. 2002-97444). It may be possible to apply this technique to achieve low temperature fixing of a toner. The state where the liquid plasticizer softens the thermoplastic resin by the fracture of the microcapsules is, however, maintained not only during the fixing step, but even after the fixing step, specifically even during discharging of paper. There is therefore a problem that the softened toner is deposited on a paper discharging unit to cause jamming of paper or pealing of the formed image, and this technique cannot achieve low temperature fixing of the toner.

As a technique using microcapsules in a toner, there is disclosed an image forming apparatus using a microcapsule toner, in which the toner contains microcapsules of large diameters, each containing, in a supporting material thereof, a few types of small-diameter microcapsules capsulated with capsule shells that are fracturable upon application of the predetermined stimuli, where the toner contains a pair of reactive materials that induced a coloring reaction upon mixing thereof, and one of the reactive material is dispersed inside the shell of each small-diameter microcapsule, and the other reactive material is dispersed outside the shell of each small-diameter microcapsule (see JP-A No. 2004-347893). The low temperature fixing is, however, not within the concept of the proposed technique, and this technique is not a technique that can realize the low temperature fixing. Moreover, this technique cannot achieve all of the low temperature fixing, and prevention of toner-spent and toner-filming, even combined with the aforementioned techniques.

As mentioned above, the related art cannot achieve low temperature fixing at 60° C. or lower while maintaining the hardness of the toner to the extent where the toner-spent and toner-filming are prevented in a developing unit at the temperature close to 50° C.

Accordingly, there have currently been demands for a toner, which excel in fixing ability with low fixing temperature (e.g., 60° C. or lower), heat resistant storage stability, and prevention of toner spent and filming of the toner.

SUMMARY OF THE INVENTION

The present invention solves various existing problems in the art and achieve the following object. Namely, an object of the present invention is to provide a toner, which excels in fixing ability with low fixing temperature (e.g., 60° C. or lower), heat resistant storage stability, and prevention of toner spent and filming of the toner.

The means for solving the aforementioned problems are as follows:

That is, a toner which contains:

a binder resin;

a colorant; and capsules, wherein the binder resin contains a thermoplastic elastomer, and wherein the capsules each encapsulate a plasticizer capable of softening the thermoplastic elastomer and the capsules are fractured upon application of predetermined pressure.

The present invention can solve the various existing problems in the art, and provide a toner, which excel in fixing ability with low fixing temperature (e.g., 60° C. or lower), heat resistant storage stability, and prevention of toner spent and filming of the toner.

DETAILED DESCRIPTION OF THE INVENTION (Toner)

The toner of the present invention contains at least a binder resin, a colorant, and capsules, and may further contain other components, if necessary.

The binder resin contains at least a thermoplastic elastomer, and may further contain other components, if necessary.

The capsules each encapsulate a plasticizer capable of softening the thermoplastic elastomer, and are fractured by predetermined.

With an image forming apparatus using a conventional toner, the toner is typically fixed on a recording medium such as paper by applying pressure to the toner with heating the toner to the temperature which is a temperature or higher at which the toner is softened by a fixing unit. The heating temperature is typically 120° C. to 160° C. In this fixing system, the consumption electric power used for the heating occupies the large proportion of the entire consumption electric power of the image forming apparatus. Accordingly, if the toner can be fixed onto a recording medium such as paper at the heating temperature (as a temperature of the toner, approximately 40° C. to approximately 50° C.) close to ordinary temperature, the consumption electric power can be reduced by 50% or greater compared to that of a conventional image forming apparatus.

Meanwhile, "toner-spent" and "toner-filming" occur because the temperature of the toner increases due to friction heat caused by frictions between the toner particles, or the toner particles with devices in an image forming apparatus to thereby soften the toner. The increase in the temperature of the toner due to the friction heat is varied depending on the printing speed, but it is typically around appropriately 50° C.

When the fixing temperature is set close to ordinary temperature to significantly reduce the consumption electric powder, the fixing temperature and the range of the temperature of the toner due to the friction heat within the image forming apparatus overlaps to each other, and therefore the conventional toner cannot achieve both fixing at the temperature close to ordinary temperature (low temperature fixing, e.g., at 60° C. or lower), and prevention of toner-spent and toner-filming.

The present inventors have found out that the aforementioned fixing at the temperature close to ordinary temperature, and prevention of toner-spent and toner-filming are achieved by applying two types of physical stimuli to the toner, and designing the toner to be softened only when the physical stimuli of greater than a certain threshold values is applied.

Figure 1:
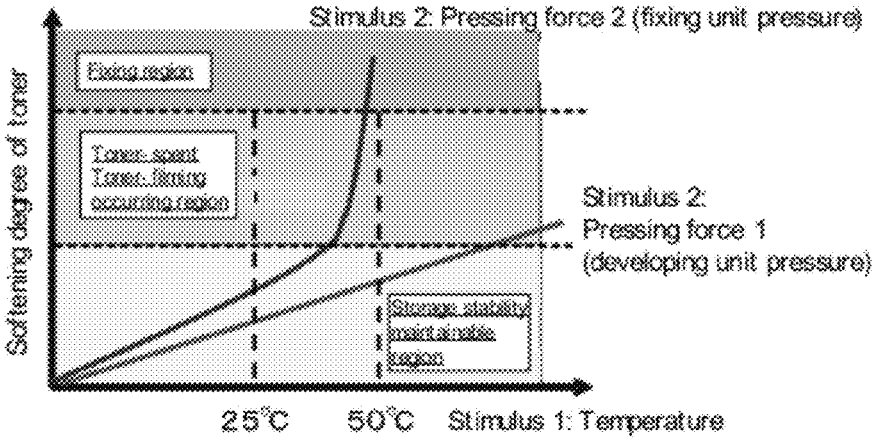
FIG. 1 is a graph depicting a state of the toner of the present invention when heat and pressure are applied as physical stimuli.

One of the two types of the physical stimuli is heat, and the other is pressure. FIG. 1 depicts a graph illustrating the state of the toner of the present when the heat and pressure are applied as the physical stimuli. As depicted in FIG. 1, determining that the stimulus 1 is heat (temperature), and the stimulus 2 is pressure (welding force), the toner is not softened to such an extent that toner-spent and toner-filming occur when the heating temperature (stimulus 1) is, for example, 50° C., as long as the pressure (stimulus 2, stimulus 1: developing unit pressure) applied to the toner in the developing unit is the threshold value or lower. When the pressure (stimulus 2, stimulus 2: fixing unit pressure) applied to the toner in the fixing unit is higher than the threshold value at the heating temperature (stimulus 1) of 50° C., the toner is softened sufficiently for fixing in the fixing unit. Even when the temperature of the fixing unit and the temperature of the fixing unit are the same as described above, fixing (low temperature fixing) at the temperature close to ordinary temperature, and prevention of toner-spent and toner-filming can all be achieved, if the toner can be designed to be softened only in the fixing unit with the pressure, which is the other physical stimulus.

In order to set the threshold value of the pressure in the fixing unit, the present inventors have reached the conclusion that the pressure at which capsules encapsulating a plasticizer capable of softening a binder resin, which are dispersed in the toner, are fractured can be set as a threshold value. When the pressure above the threshold value is applied to the capsules, each of which encapsulates the plasticizer capable of softening the binder resin, in the fixing unit, the capsules are fractured to bleed the plasticizer out, and the plasticizer is penetrated into the toner to thereby soften the binder resin. Compared to the conventional method for softening the binder resin in the toner with heat, this method is significantly different in that the capsules encapsulating plasticizer in the toner are fractured with the pressure and the bled plasticizer softens the binder resin.

However, a new problem arises when the toner contains only a binder resin and capsules each encapsulating a plasticizer and the toner is softened by the plasticizer. The problem is described as follow.

Figure 2:
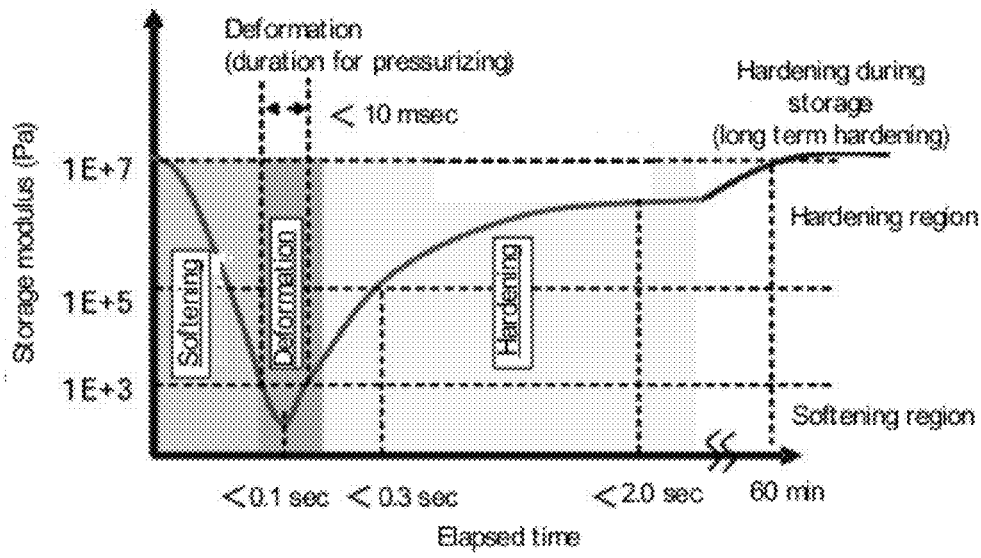
FIG. 2 is a graph depicting a state of the toner on the output sheet from the fixing step, when the plasticizer encapsulated in capsules is added to the toner.

FIG. 2 depicts a graph illustrating a change in the state of the toner from the fixing step to the discharging of paper.

As depicted in FIG. 2, the toner is, for example, softened and deformed by a pressurizing member of a fixing unit within 0.1 seconds in the fixing unit, and thereafter, the print (recording medium) is passed through a discharging member in the device over about 0.3 seconds. At the time when the print passes the discharging unit, the toner needs to be hardened at a certain degree. This is because, the softened toner may be deposited on the discharging member. Typically, the toner softened by the plasticizer however maintains its softened state and is not be hardened, unless the plasticizer is removed from the toner. Therefore, the softened toner is deposited on the discharging member, which may cause jamming of paper or pealing of images, degrading the reliability of a device.

In FIG. 2, "E" in the numerical values written along the ordinate axis denotes exponentiation of 10, for example, "1E+5" represents 100,000.

To prevent the aforementioned problem, the present inventors have come up to the solution that a thermoplastic elastomer is contained in a resin and the thermoplastic elastomer is softened by a plasticizer.

Figure 3A:
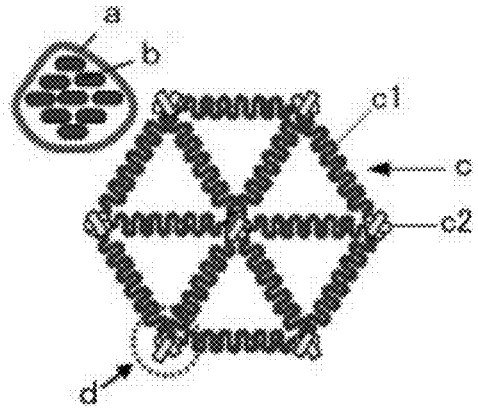
FIG. 3A is a conceptual diagram illustrating a state of the thermoplastic elastomer and plasticizer contained in the toner during storage of the toner.
Figure 3B:
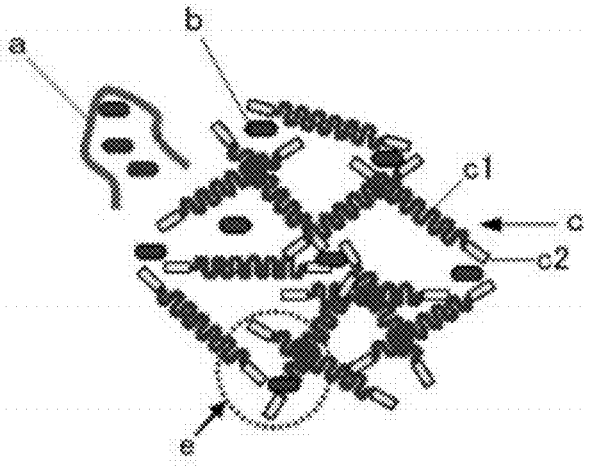
FIG. 3B is a conceptual diagram illustrating a state of the thermoplastic elastomer and plasticizer contained in the toner during the fixing.
Figure 3C:
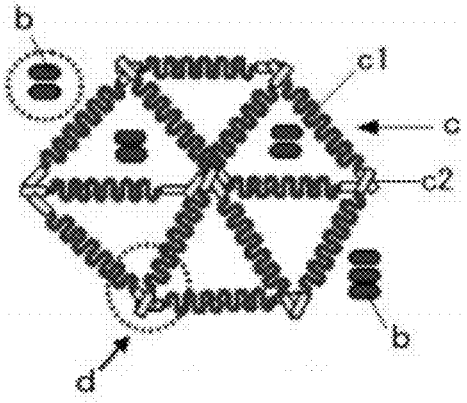
FIG. 3C is a conceptual diagram illustrating a state of the thermoplastic elastomer and plasticizer contained in the toner when output.

FIGS. 3A to 3C depict the state of the thermoplastic elastomer in the toner. FIG. 3A is a conceptual diagram illustrating the state of the thermoplastic elastomer and the plasticizer in the toner during the storage. FIG. 3B is a conceptual diagram illustrating the state of the thermoplastic elastomer and the plasticizer in the toner during the fixing. FIG. 3C is a conceptual diagram illustrating the state of the thermoplastic elastomer and the plasticizer in the toner during the discharging of paper. The thermoplastic elastomer c in FIGS. 3A to 3C is a block copolymer having a hard segment c2, which is rigid, and a soft segment c1 having rubber elasticity. The thermoplastic elastomer c does not have fluidity as the hard segments c2 form physical crosslinks with each other due to intermolecular force thereof, and exhibits rubber properties due to elasticity of the soft segment c. The plasticizer b in FIGS. 3A to 3C is a solid at ordinary temperature, and has plasticity at least to the hard segment c2 of the thermoplastic elastomer c.

In the present specification, the term "physical crosslink(s)" expresses the state where two or more hard segments are gathered to each other due to the intermolecular force thereof to thereby restrain their molecular activities.

As illustrated in FIG. 3A, the thermoplastic elastomer c in the toner exhibit elastic deformation during the storage of the toner, but the thermoplastic elastomer c does not have fluidity because of physical crosslinks d formed with hard segments c2 to each other, and therefore does not exhibit plastic deformation. In addition, the capsules a are not fractured, and therefore the plasticizer b does not bleed out. This is the same in the developing unit.

During the fixing, the pressure exceeding the threshold value is applied to the toner, as well as heating the toner. As a result, as illustrated in FIG. 3B, capsules a are fractured so that the plasticizer b is bled out. The physical crosslink d between the hear segments c2 of the thermoplastic elastomer c is broken down by the softening effect of the bled plasticizer b (see the section indicated with "e"), and then the thermoplastic elastomer c is softened drastically. The toner is softened (sharp melt) corresponding to the drastic softening of the thermoplastic elastomer.

Typically, in many parts of the thermoplastic resin, molecules thereof are interacted to each other with intermolecular force. To relax the interaction between the molecules, a large amount of the plasticizer is required, and the response of the thermoplastic resin to be softened is slow.

On the other hand, the thermoplastic elastomer can form physical crosslinks only with a hard segment thereof, and the soft segment thereof is naturally in a soft state. Accordingly, the plasticizer can act to relax only the physical crosslinks of the hard segment. Accordingly, use of the thermoplastic elastomer can reduce the concentration of the plasticizer, and can accelerate softening response.

The softened toner in the fixing unit is self-cooled at the time of discharging. As illustrated in FIG. 3C, at the time of discharging, the plasticizer b, which is contained in the toner and is a solid at ordinary temperature, loses fluidity, and detached from the hard segment c2. As a result, the plasticizer b and the thermoplastic elastomer c causes a phase separation. Because of the phase separation, the softened thermoplastic elastomer c again forms therein physical crosslinks d with the hard segments c2 to each other, and hence the toner is again hardened.

The present inventors have found that the thermoplastic elastomer has properties that hard segments thereof tend to form physical crosslinks to each other, unlike a common thermoplastic resin, and the hard segments tend to re-bond to each other as the plasticizer is solidified, whereby the hardening thereof is accelerated compared to a common thermoplastic resin. When the thermoplastic elastomer is used, moreover, the hardening thereof is faster than that of a common thermoplastic resin even with a plasticizer that is a liquid at ordinary temperature.

A common thermoplastic resin is in the state of a tacky liquid when it contains a liquid plasticizer, but the thermoplastic elastomer containing a liquid plasticizer is in the state of a semi-solid gel. When a typical water-soluble polymer is dissolved in water, the resultant remains as the state of a tacky liquid. On the other hand, after dissolving a polymer gel in water, polymer molecules thereof form crosslinks as cooled, to be gelatinized with including water therein to thereby be in the state of the semi-solid. The aforementioned state of the thermoplastic elastomer is similar to this phenomenon. In the case where the plasticizer is a solid at ordinary temperature, the thermoplastic elastomer containing such the plasticizer has the hardness equal to or higher than the hardness of the thermoplastic resin before adding the plasticizer. These are the findings of the present inventors.

<Binder Resin>

The binder resin contains at least a thermoplastic elastomer, and may further contain other resins, if necessary.

—Thermoplastic Elastomer—

The thermoplastic elastomer is a resin which behaves as a rubber elastomer at ordinary temperature and causes plastic deformation as temperature increases.

In the present specification, the "ordinary temperature" is the temperature which is achieved without heating or cooling, and is preferably 5° C. to 35° C. as defined in JIS Z8703.

The thermoplastic elastomer is appropriately selected depending on the intended purpose without any limitation, and the thermoplastic elastomer preferably contains a hard segment and a soft segment.

The thermoplastic elastomer is preferably a block copolymer having the hard segment and the soft segment, more preferably a A-B-A triblock copolymer (where A denotes a hard segment, and B denotes a soft segment).

In the specification, the term "hard segment" means a molecular motion-restricted component, which is equivalent to a crosslink point of vulcanized rubber, and prevents plastic deformation, and the term "soft segment" means a flexible component exhibiting rubber elasticity.

The hard segment of the thermoplastic elastomer is appropriately selected depending on the intended purpose without any limitation, and examples thereof include polyethylene, polystyrene, polyester (e.g., polyethylene terephthalate), polyacrylate, polyurethane, polypropylene, polyamide, and polyvinyl chloride.

The soft segment of the thermoplastic elastomer is appropriately selected depending on the intended purpose without any limitation, and examples thereof include polybutadiene, hydrogenated polybutadiene, hydrogenated polyisoprene, polyether, polyester, polyalkyl acrylate, and polyvinyl acetate.

Note that, the polyester and polyvinyl chloride can be the hard segment or the soft segment depending on the specific constitutions thereof.

A mass ratio of the hard segment and the soft segment is appropriately selected depending on the intended purpose without any limitation, but the mass ratio (hard segment:soft segment) of the hard segment to the soft segment is preferably 1:9 to 6:4. When the ratio of the hard segment is lower than 1:9 in the mass ratio, the toner may constantly have tackiness. When the ratio of the hard segment is higher than 6:4, the resulting toner becomes excessively hard so that the toner cannot secure sufficient softness required for fixing.

Specific examples of the thermoplastic elastomer include: styrene-butadiene-styrene (SBS) where the hard segment is polystyrene and the soft segment is polybutadiene; styrene-hydrogenated butadiene-styrene (SEBS) where the hard segment is polystyrene and the soft segment is hydrogenated polybutadiene; styrene-isoprene-styrene (SEPS) where the hard segment is polystyrene and the soft segment is polyisoprene; polyurethane-polyether-polyurethane (TPU) where the hard segment is polyurethane and the soft segment is polyether; ethylene-vinyl acetate-ethylene (EVA) where the hard segment is polyethylene and the soft segment is polyvinyl acetate; and TPVC where the hard segment is polyvinyl chloride and the soft segment is polyvinyl chloride.

An amount of the thermoplastic elastomer is appropriately selected depending on the intended purpose without any limitation, but it is preferably 50% by mass to 95% by mass relative to the binder resin.

The present inventors have moreover found that a ratio of the thermoplastic elastomer to other binder resins (the binder resin exclusive of the thermoplastic elastomer) affects elastic deformation caused only by pressure. In the case where the thermoplastic elastomer is SBS and the other binder resin is polystyrene, for example, the elastic deformation caused only by pressure becomes smaller as the mass ratio of polystyrene to SBS because higher, and eventually the plastic deformation of the toner is caused only by pressure. If the plastic deformation of the toner is caused only by pressure, in a unit for applying electric charge to the toner by frictions between toner particles within the developing unit, the toner deforms with the pressure caused by the frictions between the toner particles, which may cause problems in developing, or in some cases the toner may cause toner-filming to a developing sleeve. Accordingly, it is desired that the toner is designed to cause only elastic deformation by the pressure for applying charges in a developing unit, without causing plastic deformation. The present inventors have found from the experiments that a mass ratio (SBS:polystyrene) of SBS to polystyrene is preferably 95:5 to 50:50, more preferably 90:10 to 70:30. When the proportion of the polystyrene is less than 5 in the mass ratio, the toner layer (the toner transferred to a recording medium) becomes tacky after fixing, which may cause blocking as another recording medium such as printing paper is stacked thereon, and it is difficult for the binder resin to engage with pulp fibers of the printing paper during fixing, which may reduce anchoring to the paper and cause fixing failure. When the proportion of the polystyrene is greater than 50 in the mass ratio, the toner is deformed by the pressure necessary to give frictions between the toner particles in the developing unit, which may cause developing failures. When the mass ratio is within the aforementioned preferable range, it is advantageous because images can be formed without causing blocking, fixing failure and developing failure.

The optimal ratio, i.e., the aforementioned more preferable range, varies depending on the molecular weight of the thermoplastic elastomer, a ratio between the hard segment and the soft segment, or the molecular weight of the binder resin, and therefore the optimal ratio needs to be determined depending on a combination of the thermoplastic elastomer to other binder resins.

Note that, the aforementioned preferable range of the mass ratio is applicable to other combinations than the combination of SBS and polystyrene.

—Other Resins—

The aforementioned other resins are appropriately selected depending on the intended purpose without any limitation, but they are preferably resin softened by the plasticizer. Since the other resins are softened by the plasticizer, the binder resin is easily engaged with pulp fibers of printing paper, which strengthens anchoring force to the paper, and improves fixing ability of the toner.

The aforementioned other resins are moreover preferably the resin compatible to the thermoplastic elastomer. The resin compatible to the thermoplastic elastomer include, for example, in the case where the thermoplastic elastomer contains a hard segment and a soft segment, resins having the similar structures to the structure of the hard segment.

Examples of the aforementioned other resins include: polymers each formed of a sole monomer or a monomer mixture of two or more, the monomer being selected from a styrene-based monomer, an acryl-based monomer, and a methacryl-based monomer; and resins such as a polyester resin, a polyol resin, a polyurethane resin, a furan resin, an epoxy resin, a xylene resin, a terpene resin, a coumarone-indene resin, a polycarbonate resin, and a petroleum resin.

Examples of the polymer include polystyrene, and polybutyl acrylate.

The aforementioned other resins moreover include a modified polyester resin. The modified polyester resin is a polyester resin where there is a bonding group in the resin, exclusive of a functional group and an ester bond contained in a monomer unit, or where there is a resin component having a different structure is bonded to the resin by covalent bonding or ionic bonding.

The modified polyester resin include, for example, those obtained by allowing an active hydrogen group-containing compound to react with a polyester resin containing a functional group reactive with an active hydrogen group of the active hydrogen group-containing compound to thereby undergo an elongation reaction or crosslink reaction of the polyester, and examples of such modified polyester include a urea-modified polyester resin, and urethane-modified polyester resin.

The active hydrogen group-containing compound includes, for example, amines. Examples of the amines include diamine, trivalent or higher polyamine, aminoalcohol, amino mercaptan, amino acid, and a blocked compound where an amino group of any of the receding amines is blocked. These may be used alone or in combination.

<Colorant>

The colorant is appropriately selected from dyes and pigments known in the art depending on the intended purpose without any restriction, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. These may be used alone, or in combination.

The colorant may form a composite with a resin for master batch, and may be used as a master batch.

A resin kneaded together with the master batch is appropriately selected depending on the intended purpose without any limitation.

<Capsules>

The capsules each encapsulate a plasticizer capable of softening the thermoplastic elastomer.

The capsules are capsules which are fractured upon application of predetermined pressure. The predetermined is appropriately selected depending on the intended purpose without any limitation, provided that it is the pressure applied at the time of fixing, but it is preferably higher than 0.5 MPa, more preferably 1 MPa or higher. The upper limit of the pressure is appropriately selected depending on the intended purpose without any limitation, but it is preferably 5 MPa or lower, more preferably 2 MPa or lower. The predetermined pressure is the set pressure at a nip of a fixing unit of an image forming apparatus.

As a difference in the pressure (nip pressure) of a fixing unit and the pressure applied to the toner within a developing unit is larger, the durability of the toner increases. If the pressure of the fixing unit is set excessively high (e.g., 10 MPa or higher), however, the mechanical structure of the fixing unit needs to be durable, which leads to increases in the size and weight of the fixing unit. Considering the size and weight of the fixing unit intended to use in a desk-top or floor photocopier or printer used in typical offices, the pressure applied to the fixing unit is typically 5 MPa or lower, preferably 1 MPa or lower. The pressure applied to induce frictions between the toner particles within the image forming apparatus is considered to be 0.5 MPa or lower.

Accordingly, the capsules are preferably capsules that are not fractured by an application of the pressure of about 0.5 MPa, but fractured by an application of the pressure of 1 MPa or higher.

Each capsule has a shell (outer coat).

Particle diameters of the capsules and thickness of the shells greatly affect the fracture strength of the capsules. The present inventors have found that, when the shell is formed of a resin component and the diameters of the capsules are 1 mm or smaller, a ratio between the particle diameter of the capsule and the thickness of the shells affects the fracture of the capsules. In the case the pressure required for fracturing the capsules with the fixing unit is about 1 MPa, a ratio (particle diameter of capsule:thickness of shell) of the particle diameter of the capsule to the thickness of the shell is preferably 20:1 to 5:1.

The lower limit of the diameters of the capsules greatly affects the face resistance of the shell relative to the thickness thereof. In the case where the thickness of the shell of each capsule is the degree of several molecular chains, the strength of the capsules cannot be maintained. Having that the distance between molecular chains be appropriately 0.3 nm, the thickness of the shell is desired to be 10 molecular chains or more. Considering the ratio of the particle diameters and the thickness of the shell, the diameters of the capsules which can be fractured by the pressure of 1 MPa are preferably 60 nm or greater.

The upper limit of the particle diameter of the capsule affects the concentration of the plasticizer relative to the thermoplastic elastomer in the toner, which is required for fixing, and penetration of the plasticizer into the binder resin after the fracture of the capsules.

An amount of the plasticizer is preferably 5 parts by mass to 30 parts by mass, more preferably 10 parts by mass to 20 parts by mass, relative to 100 parts by mass of the thermoplastic elastomer. When the shell of the capsule is thin, a mass of the capsule and a mass of the plasticizer can be regarded as the same.

The duration for applying pressure at the nip of the fixing unit varies depending on the printing speed, and pressurizing nip width, but it is about 10 ms to about 30 ms. Therefore, it is important that the plasticizer is uniformly diffused in the binder resin within a short period of time after the fracture of the capsules fracture.

Accordingly, the plasticizer cannot be penetrated into the binder resin when the capsules are apart from each other within the binder resin in the toner, which may cause fixing failure because the toner is not sufficiently softened. The diffusion of the plasticizer into the binder resin is determined by a diffusion coefficient. When the diffusion coefficient is about $1\times10^{-12}$ to about $1\times10^{-13}$, the penetratable distance is about 100 nm to about 200 nm within the nip duration of 10 ms to 30 ms. Specifically, it is preferred that the plasticizer capsules be dispersed in the binder resin so that a distance between capsules is to be 100 nm to 200 nm.

Accordingly, to achieve that the amount of the plasticizer is 10 parts by mass to 20 parts by mass relative to 100 parts by mass of the thermoplastic elastomer, and a distance between the capsules is 100 nm to 200 nm, the upper limit of the particle diameters of the capsules is 400 nm.

Specifically, the diameters of the capsules are preferably in the range of 60 nm to 400 nm.

For example, the particle diameters of the capsules can be determined, as the average value, by observing the capsules under a transmission electron microscope (TEM) or a scanning electron microscope (SEM). Alternatively, the particle diameters of the capsules can be determined by measuring a liquid in which the capsules are dispersed by means of a concentrated-system particle analyzer FPAR-1000 (manufactured by Otsuka Electronics Co., Ltd.) by dynamic light scattering.

The shell (outer coat) of each capsule is appropriately selected depending on the intended purpose without any limitation, provided that it is a shell fractured upon application of the predetermined pressure.

As for a material of the shell, for example, an inorganic material, and a resin are included.

Examples of the resin include polyvinyl alcohol (PVA), a melamine resin, a polyamide resin, a polyethylene resin, a nylon resin, and an acrylic resin.

Moreover, it is preferred that the shell be insoluble to a solvent used during the production of the toner.

—Plasticizer—

The plasticizer is appropriately selected depending on the intended purpose without any limitation, provided that it is a plasticizer capable of softening the thermoplastic elastomer.

The plasticizer is preferably a plasticizer compatible to the hard segment of the thermoplastic elastomer.

The state of "compatible to" means a state where a contact surface between the plasticizer in the state of a liquid and the thermoplastic elastomer is swollen or exhibits tackiness when they are in contact with each other, or a state where storage elastic modulus is $1\times10^{4}$ Pa or lower when 30 parts by mass of the plasticizer is mixed and kneaded with 100 parts by mass of the thermoplastic elastomer.

The plasticizer is preferably a plasticizer that is a solid at ordinary temperature.

A melting point of the plasticizer is appropriately selected depending on the intended purpose without any limitation, but it is preferably 30° C. to 60° C. When the melting point of the plasticizer is within the aforementioned preferable range, heat capacity required for melting is low, which is advantageous in terms of energy saving.

Specific examples of the plasticizer include n-alkanes, dibasic acid dialkyl esters, fatty acid dialkoxyalkyl esters, fatty acid dialkoxyalkoxyalkyl esters, long-chain organic acid, dicylohexyl phthalate, 4-butoxyphthalonitrile, paraffin chloride, and triphenyl phosphate.

These plasticizers may be used alone, or in combination. As the plasticizer, moreover, a plasticizer in the state of a paste is also preferable, which is obtained by mixing a plasticizer in the state of a liquid at ordinary temperature and a plasticizer in the state of a solid at ordinary temperature.

Examples of the n-alkanes being in the state of a liquid at ordinary temperature include n-decane, n-dodecane, n-tridecane, and tetradecane.

Examples of the n-alkanes being in the state of a solid at ordinary temperature include n-octadecane, n-heptadecane, n-nonadecane, and paraffin having the melting point of 40° C. to 50° C.

Examples of the dibasic acid dialkyl esters being the state of a liquid at ordinary temperature include diethyl adipate, diisobutyl adipate, dimethyl sebacate, and dioctyl phthalate.

Examples of the fatty acid dialkoxyalkyl esters being the state of a liquid at ordinary temperature include diethoxyethyl succinate, diethoxyethyl adipate, and dimethoxyethyl adipate.

Examples of the fatty acid dialkoxyalkoxyalkyl esters being the state of a liquid at ordinary temperature include diethoxyethoxyethyl succinate, and diethoxyethoxyethyl adipate.

Examples of the long-chain organic acid being in the state of a solid at ordinary temperature include lauric acid, myristic acid, palmitic acid, stearic acid, and a mixture thereof.

Since the structure of the n-alkanes is similar to the structure of ethylene, that is the hard segment, the n-alkanes are suitable as a plasticizer for EVA serving as the thermoplastic elastomer.

The dibasic acid dialkyl esters, fatty acid dialkoxyalkyl esters, fatty acid dialkoxyalkoxyalkyl esters, long-chain organic acid, dicylohexyl phthalate, 4-butoxyphthalonitrile, paraffin chloride, and triphenyl phosphate are suitable as a plasticizer for the thermoplastic elastomer of SBS, SEBS, or SEPB, whose hard segment is styrene.

In the case where the hard segment of the thermoplastic elastomer is polystyrene, the plasticizer is preferably an aromatic compound, such as aromatic ester, aromatic ether, and an alkoxy group-containing aromatic compound.

Examples of the aromatic ester include an ester formed between aromatic carboxylic acid and aliphatic alcohol. As for the aromatic carboxylic acid, a monovalent to tetravalent aromatic carboxylic acid is preferable, and a monovalent to divalent aromatic carboxylic acid is more preferable. As for the aliphatic alcohol, a C1-C18 aliphatic alcohol is preferable, and a C1-C12 aliphatic alcohol is more preferable. Specific examples of the aromatic ester include dibutyl phthalate, di(2-ethylhexyl) phthalate, dinonyl phthalate, didecyl phthalate, didodecyl phthalate, ditridecyl phthalate, tributyl trimellitate, tri(2-ethylhexyl) trimellitate, trinonyl trimellitate, tridecyl trimellitate, tridodecyl trimellitate, and tri-tridecyl trimellitate. When a divalent or higher aromatic carboxylic acid is used, the aromatic ester may be, naturally, a simple ester formed with a sole aliphatic alcohol, or a complex ester formed with two or more types of aliphatic alcohol.

Examples of the aromatic ether include 1,2-diphenoxyethane, 1,4-diphenoxybutane, 1,2-bis(3-methylphenoxy) ethane, 1,2-bis(4-methoxyphenoxy)ethane, 1,2-bis(3,4-dimethylphenyl)ethane, 1-phenoxy-2-(4-chlorophenoxy)ethane, 1-phenoxy-2-(4-methoxyphenoxy)ethane, and 1,2-diphenoxymethylbenzene.

Examples of the alkoxy group-containing aromatic compound include 2,4-dimethoxyacetophenone, and 1,3,5-trimethoxybenzene.

Use of a solid plasticizer at ordinary temperature as the plasticizer enables to increase the strength of the capsules.

The capsules formed of the shells having flexibility, such as a resin, are generally resistant to fracture, and cannot be fractured by application of high pressure, such as of about 20 MPa, when a compressible material, such as gas, is contained inside the shell.

When the capsule is filled with a non-compressible liquid, the deformation of the capsule boosts the internal pressure of the capsule, which creates a force of the liquid to comes out from the inside the capsule. Therefore, there is a case where the capsules are easily fractured with the pressure of 1 MPa or lower.

Such capsules each encapsulating the liquid are easily fractured with relatively low pressure.

When a material encapsulated in the capsule is a solid, by contrast, the deformation of the capsule by the pressure itself is prevented so that the internal pressure of the capsule is not increased, and hence it is hard to fracture the capsule. Specifically, even when pressure is applied to the toner in the developer unit or the like inside the image forming apparatus at the temperature that is lower than the melting point of the solid plasticizer, the fracture of the capsules each encapsulating the plasticizer can be prevented and therefore the storage stability of the toner improves.

As mentioned earlier, an amount of the plasticizer is preferably 5 parts by mass to 30 parts by mass, more preferably 10 parts by mass to 20 parts by mass, relative to 100 parts by mass of the thermoplastic elastomer.

—Production Method of Capsules—

The production method of the capsules is appropriately selected depending on the intended purpose without any limitation, and for example, the capsules can be produced by generally known, so-called, microcapsulation. Examples of the microcapsulation include: a method for forming a shell at an interface between two phases in an emulsion system of an oil phase and aqueous phase, such as an interface polymerization method, and in-situ polymerization method; a method for forming a shell utilizing evaporation and aggregation in an emulsion of an oil phase and an aqueous phase, such as liquid drying and coacervation; a method for forming a shell with a photo-curing resin, or a thermoset resin; a method for granulating by directly supplying a dispersing phase to a continuous phase using a micro flow channel; and a method for spray drying an O/W emulsion containing an oil phase including the plasticizer, and an aqueous phase containing material(s) for forming the shell.

<Other Components>

Examples of the aforementioned other components include inorganic particles, a magnetic material, a charge controlling agent, external additives, a flow improving agent, a cleaning improving agent, and a metallic soap.

—Inorganic Particles—

Examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Hydrophobic treatment to these inorganic particles is moreover preferable because the resulting hydrophobic inorganic particles can improve their dispersibility in the binder resin.

The presence of the inorganic particles having appropriate properties inside the toner can achieve fine dispersion of the toner composition, that include the binder resin, the colorant, and wax. This is because the presence of the inorganic particles gives mixing shear force due to a filler effect, to thereby homogeneously mix the toner composition.

The average primary particle diameter (may referred to merely as "the average particle diameter" hereinafter) of the inorganic particles is appropriately selected depending on the intended purpose without any limitation, but it is preferably 10 nm to 1,000 nm, more preferably 50 nm to 600 nm. When the average primary particle diameter thereof is smaller than 10 nm, inorganic particles tend to cause aggregation, which may lead to low volume specific resistance of the toner, and degraded dispersibility of the toner composition. When the average primary particle diameter thereof is greater than 1,000 nm, the dispersing effect owing to the filler effect may not be attained.

The inorganic particles can also be used as external additives.

—Magnetic Material—

The magnetic material is appropriately selected depending on the intended purpose without any limitation, and examples thereof include: magnetic iron oxide (e.g., magnetite, maghemite, and ferrite) and iron oxide containing other metal oxide; metal (e.g., iron, cobalt, and nickel) or alloys of these metals with a metal (e.g., aluminum, cobalt, copper, lead, magnesium, tin, zinc, antimony, beryllium, bismuth, cadmium, calcium, manganese, selenium, titanium, tungsten, and vanadium); and a mixture thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These may be used alone, or in combination. Among them, $Fe_3O_4$ powder and $\gamma$-$Fe_2O_3$ powder are particularly preferable.

Moreover, magnetic iron oxide (e.g., magnetite, maghemite, and ferrite) containing heterologous element(s) and a mixture thereof can also be used.

Examples of the heterologous element include lithium, beryllium, boron, magnesium, aluminum, silicon, phosphorus, germanium, zirconium, tin, sulfur, calcium, scandium, titanium, vanadium, chromium, manganese, cobalt, nickel, copper, zinc, and gallium. Among them, magnesium, aluminum, silicon, phosphorus, and zirconium are preferable.

The heterologous element may be incorporated into a crystal lattice of iron oxide, or incorporated as oxide in iron oxide, or present on a surface of iron oxide as oxide or hydroxide. It is however preferred that the heterologous element be incorporated as oxide in the iron oxide.

The heterologous element can be incorporated into particles of the magnetic material, for example, by mixing salts of the hetelogous element during the production of the magnetic material, and adjusting the pH thereof. In addition, the heterologous element can be deposited on surfaces of the particles by adjusting the pH or adding a salt of each element after the production of the magnetic material particles.

An amount of the magnetic material is appropriately selected depending on the intended purpose without any limitation, but it is preferably 10 parts by mass to 200 parts by mass, more preferably 20 parts by mass to 150 parts by mass, relative to 100 parts by mass of the binder resin.

The number average particle diameter of the magnetic material is appropriately selected depending on the intended purpose without any limitation, but it is preferably 0.1 μm to 2 μm, more preferably 0.1 μm to 0.5 μm.

The number average particle diameter of the magnetic material can be determined by measuring an enlarged photograph taken by a transmission electron microscope using a digitizer or the like.

The magnetic properties of the magnetic material are appropriately selected depending on the intended purpose without any limitation. The magnetic material preferably has the magnetic properties, specifically, coercive force of 20 Oe to 150 Oe, saturation magnetization of 50 emu/g to 200 emu/g, and residual magnetization of 2 emu/g to 20 emu/g, when the magnetic field of 10 KOe is applied.

The magnetic material can also be used as a colorant.

—Charge Controlling Agent—

The charge controlling agent is appropriately selected from those known in the art depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

As for the charge controlling agent, commercial products can be used. Examples of the commercial products include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901, boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

An amount of the charge controlling agent is appropriately selected depending on the intended purpose without any limitation, but it is preferably 0.1 parts by mass to 10 parts by mass, more preferably 0.2 parts by mass to 5 parts by mass, relative to 100 parts by mass of the binder resin. When the amount thereof is greater than 10 parts by mass, the charging ability of the toner becomes excessive, which may reduce the effect of the charge controlling agent, increase electrostatic force to a developing roller, leading to low flowability of the developer, or low image density of the resulting image.

These charge controlling agents may be dissolved and dispersed after being melted and kneaded together with the master batch, and/or binder resin. The charge controlling agents can be, of course, directly added to an organic solvent when dissolution and dispersion is performed. Alternatively, the charge controlling agents may be fixed on surfaces of toner base particles after the production of the toner base particles.

—External Additives—

The external additives are appropriately selected depending on the intended purpose without any limitation, and examples thereof include silica particles, hydrophobic silica particles, fatty acid metal salts (e.g., zinc stearate, and aluminum stearate); metal oxide (e.g., titania, alumina, tin oxide, and antimony oxide) or hydrophobic products thereof; and fluoropolymers.

Among them, hydrophobic silica particles, titania particles, and hydrophobic titania particles are preferable.

Examples of the silica particles include R972, R974, RX200, RY200, R202, R805, and R812 (all manufactured by Nippon Aerosil Co., Ltd.).

Examples of the titania particles include: P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION).

Examples of the hydrophobic titania particles include: T-805 (manufactured by Nippon Aerosil Co., Ltd.); STT-30A, and STT-65S-S (both manufactured by Titan Kogyo, Ltd.); TAF-500T, and TAF-1500T (both manufactured by Fuji Titanium Industry Co., Ltd.); MT-100S, and MT-100T (both manufactured by TAYCA CORPORATION); and IT-S (manufactured by ISHIHARA SANGYO KAISHA, LTD.).

The hydrophobic silica particles, hydrophobic titania particles, and hydrophobic alumina particles can be obtained by treating (subjecting to hydrophobic treatment) hydrophilic particles with a hydrophobic treatment agent.

Examples of the hydrophobic treatment agent include: a silane coupling agent (e.g., dialkyl dihalogenosilane, trialkyl halogenosilane, alkyl trihalogenosilane, and hexylkyl disilazane), a sililating agent, a silane coupling agent containing a fluoroalkyl group, an organic titanate-based coupling agent, an aluminum-based coupling agent, silicone oil, and silicone varnish.

Use of silicone oil-treated inorganic particles is also preferable, where the silicone oil-treated inorganic particles are inorganic particles which have been treated (optionally upon application of heat) with silicone oil.

Examples of the inorganic particles include silica, alumina, titanium dioxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica, and titanium dioxide are particularly preferable.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl or methacryl-modified silicone oil, and α-methylstyrene-modified silicone oil.

The average primary particle diameter of the inorganic particles is appropriately selected depending on the intended purpose without any limitation, but it is preferably 1 nm to 100 nm, more preferably 3 nm to 70 nm. When the average particle diameter thereof is smaller than 1 nm, the inorganic particles are embedded into the toner particles, and therefore the inorganic particles do not effectively function. When the average particle diameter thereof is greater than 100 nm, the inorganic particles may unevenly damage a surface of a latent electrostatic image bearing member, and hence not preferable.

As for the external additives, resin particles may be used. Examples of the resin particles include; polystyrene obtained by a soap-free emulsification polymerization, suspension polymerization, or dispersion polymerization; copolymer of methacrylic ester or acrylic ester; polymer particles obtained by polymerization condensation, such as silicone, benzoguanamine, and nylon; and polymer particles formed of a thermoset resin. Use of these resin particles in combination with the inorganic particles can reinforce the charging ability of the toner, reduces reverse charges of the toner, reducing background deposition.

An amount of the resin particles is appropriately selected depending on the intended purpose without any limitation, but it is preferably 0.01% by mass to 5% by mass, more preferably 0.1% by mass to 2% by mass.

An amount of the external additives is appropriately selected depending on the intended purpose without any limitation, but it is preferably 0.1% by mass to 5% by mass, more preferably 0.3% by mass to 3% by mass.

—Flow Improving Agent—

The flow improving agent is an agent capable of performing surface treatment of the toner to increase hydrophobicity, and preventing degradations of flow properties and charging properties of the toner even in a high humidity environment. Examples of the flow improving agent include a silane-coupling agent, a sililation agent, a silane-coupling agent containing a fluoroalkyl group, an organic titanate-based coupling agent, an aluminum-based coupling agent, silicone oil, and modified silicone oil.

—Cleaning Improving Agent—

The cleaning improving agent is added to the toner for the purpose of removing the developer remained on a latent electrostatic image bearing member or intermediate transfer member after transferring.

Examples of the cleaning improving agent include: fatty acid metal salt such as zinc stearate, calcium stearate, and stearic acid; and polymer particles produced by soap-free emulsification polymerization, such as polymethyl methacrylate particles, and polystyrene particles. The polymer particles are preferably those having a relatively narrow particle size distribution, and the polymer particles having the weight average particle diameter of 0.01 μm to 1 μm are preferably used.

One example of the toner containing the capsules will be explained.

Figure 4:
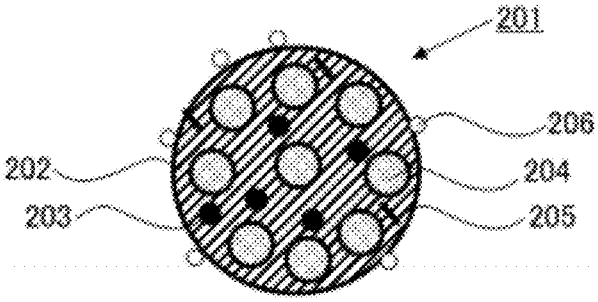
FIG. 4 is a schematic cross-sectional view illustrating the toner containing capsules.

FIG. 4 is a schematic cross-sectional view illustrating the toner containing the capsules. The toner 201 contains a binder resin 202 including a thermoplastic elastomer, a colorant 203, capsules 204 each encapsulating a plasticizer, a charge controlling agent 205, and external additives 206.

<Production Method of Toner>

The production method of the toner is appropriately selected depending on the intended purpose without any limitation, and examples thereof include a pulverization method, a polymerization method, a dissolution suspension method, and a spray granulation method. Among them, the pulverization method and dissolution suspension method are preferable.

—Pulverization Method—

The pulverization method is a method for producing toner base particles, for example, by melting and kneading a toner composition, pulverizing the resulting kneaded product, and classifying the pulverized particles.

In the melting and kneading (melt-kneading), materials of the toner composition are mixed, and the resulting mixture is placed in a melt-kneader to perform melt-kneading. As the melt-kneader, for example, a monoaxial or biaxial continuous kneader, or a batch-type kneader with a roll mill can be used. Preferable examples thereof include a twin screw extruder KTT manufactured by KOBE STEEL, LTD., an extruder TEM manufactured by TOSHIBA MACHINE CO., LTD., a twin screw extruder manufactured by ASADA WORKS CO., LTD., a twin screw extruder PCM manufactured by Ikegai Corp., and a cokneader manufactured by Buss. The melt-kneading is preferably performed under the conditions that do not fracture the capsules. As for the conditions that do not fracture the capsules, for example, the conditions adjusted by a method where a solvent that dissolves the binder resin is added to the toner composition are included. By doing so, the toner composition can be formed into the soft state.

In the pulverizing, the kneaded product obtained by the kneading is pulverized. In the pulverizing, it is preferred that the kneaded product be coarsely pulverized, followed by finely pulverized. For the pulverizing, a method in which the kneaded product is pulverized by making the kneaded product to crush into an impact plate in the jet stream, a method in which particles of the kneaded product are made crushed each other in the jet stream to thereby pulverize the kneaded product, or a method in which the kneaded product is pulverized in a narrow gap between a mechanically rotating rotor and a stator is preferably used.

Since the toner contains the thermoplastic elastomer, there is a case where the kneaded product may not be pulverized with typical conditions for pulverization. In such case, the kneaded product is preferably made frozen and then pulverized. Examples of the freeze-pulverization include a method of carrying out pulverization in the low temperature environment (e.g., 0° C. or lower).

The classifying is classifying the pulverized product obtained by the pulverizing into particles having the predetermined particle diameters. In the classification, the undesirable fine particle component can be removed by a cyclone, a decanter, a centrifugal separator, or the like.

After the completion of the pulverizing and the classifying, the classified pulverized product is classified in an air stream by centrifugal force or the like to thereby produce toner base particles having the predetermined particle diameters. The particle diameter is appropriately selected depending on the intended purpose without any limitation, and for example, it is in the range of 5 μm to 20 μm.

In the case of the pulverization method, a mechanical impact may be applied to the obtained toner base particles to control the shapes thereof in order to attain the higher average circularity. In this case, the mechanical impact can be applied to the toner base particles, for example, by means of a device such as a hybridizer, and Mechanofusion.

—Dissolution Suspension Method—

Examples of the dissolution suspension method include a method containing adding, to an aqueous medium (an aqueous phase), a solution (an oil phase) obtained by dissolving the binder resin in a solvent to thereby prepare a suspension liquid, and removing the solvent from the suspension liquid.

In the course of the preparation of the suspension liquid, additives can be dissolved and/or dispersed in the solvent, together with the binder resin.

In the dissolution suspension method, it is preferred that a solvent for use be selected from solvents that dissolve the binder resin, but not dissolving the shells of the capsules. The solvent is appropriately selected depending on the intended purpose without any limitation.

(Developer)

The developer of the present invention contains the aforementioned toner of the present invention. The toner of the present invention may be used as a one-component developer, or may be mixed with a carrier and used as a two-component developer. Among them, the two component developer is preferable in the case where it is used in recent high-speed printers corresponded to the improved information processing speed, in view of a long service life.

In the case of the one-component developer using the toner, the diameters of the toner particles do not vary largely even when the toner is balanced, namely, the toner is supplied to the developer, and consumed by developing, the toner does not cause filming to a developing roller, nor fuse to a layer thickness regulating member such as a blade for thinning a thickness of a layer of the toner, and provides excellent and stable developing ability and image even when it is used (stirred)) in the developing unit over a long period of time.

In the case of the two-component developer using the toner, the diameters of the toner particles in the developer do not vary largely even when the toner is balanced, and the toner can provide excellent and stabile developing ability even when the toner is stirred in the developing unit over a long period of time.

<Carrier>

The carrier is appropriately selected depending on the intended purpose without any limitation, but it is preferably a carrier containing carrier particles each of which contains a core and a resin layer with which the core is coated.

—Core—

A material of the core is appropriately selected depending on the intended purpose without any limitation, but it is preferably 50 emu/g to 90 emu/g manganese-strontium (Mn—Sr) material, or manganese-magnesium (Mn—Mg) material, and preferably a hard magnetic material such as iron powder (100 emu/g or higher), and magnetite (75 emu/g to 120 emu/g) for securing sufficient image density. Moreover, the material is preferably a soft magnetic material such as a copper-zinc (Cu—Zn) (30 emu/g to 80 emu/g) material because the toner particles born in the form of brush reduces an impact by contact to a latent electrostatic image bearing member, which is advantageous for providing high image quality. These may be used alone, or in combination.

The particle diameter of the core is appropriately selected depending on the intended purpose without any limitation, and as the particle diameter thereof, the average particle diameter (weight average particle diameter (D50)) thereof is preferably 10 μm to 200 μm, more preferably 40 μm to 100 μm.

When the average particle diameter (weight average particle diameter (D50)) thereof is smaller than 10 μm, the proportion of fine particles in the distribution of carrier particle diameters increases, causing carrier scattering because of low magnetization per carrier particle. When the average particle diameter thereof is greater than 200 μm, the specific surface area reduces, which may cause toner scattering, causing reproducibility especially in a solid image portion in a full color printing containing many solid image portions.

—Resin Layer—

A material of the resin layer is appropriately selected depending on the intended purpose without any limitation, and examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, copolymer of vinylidene fluoride and acryl monomer, vinylidene fluoride-vinyl fluoride copolymer, fluoroterpolymer (e.g., terpolymer of tetrafluoroethylene, vinylidene fluoride, and non-fluoromonomer), and a silicone resin. These may be used alone, or in combination.

The silicone resin is appropriately selected depending on the intended purpose without any limitation, and examples thereof include: a straight silicone resin constituted of organosiloxane bonds; and a modified silicone resin, which is modified with an alkyd resin, a polyester resin, an epoxy resin, an acryl resin, or a urethane resin.

The silicone resin can be selected from commercial products. Examples of commercial products of the straight silicone resin include KR271, KR255, and KR152 manufactured by Shin-Etsu Chemical Co., Ltd.; and SR2400, SR2406, and SR2410 manufactured by Dow Corning Toray Co., Ltd.

As for the modified silicone resin, commercial products thereof can be used. Examples of the commercial products thereof include: KR206 (alkyd-modified), KR5208 (acryl-modified), ES1001N (epoxy-modified), and KR305 (urethane-modified) manufactured by Shin-Etsu Chemical Co., Ltd.; and SR2115 (epoxy-modified), SR2110 (alkyd-modified) manufactured by Dow Corning Toray Co., Ltd.

Note that, the silicone resin can be used along, but the silicone resin can also be used together with a component capable of performing a crosslink reaction, a component for adjusting charging value, or the like.

The resin layer optionally contains electric conductive powder, and examples thereof include metal powder, carbon black, titanium oxide, tin oxide, and zinc oxide. The average particle diameter of the electric conductive powder is preferably 1 μm or smaller. When the average particle diameter thereof is greater than 1 μm, it may be difficult to control electric resistance.

The resin layer can be formed, for example, by dissolving the silicone oil or the like in a solvent to prepare a coating solution, uniformly applying the coating solution to surfaces of the core (particles) by a conventional coating method, and drying the coated solution, followed by baking. Examples of the coating method include dip coating, spray coating, and brush coating.

The solvent is appropriately selected depending on the intended purpose without any limitation, and examples thereof include toluene, xylene, methyl ethyl ketone, methyl isobutyl ketone, cellosolve, and butyl acetate.

A method for the baking is appropriately selected depending on the intended purpose without any limitation, and for example, the baking may employ an external heating system or an internal heating system.

A device used for the baking is appropriately selected depending on the intended purpose without any limitation, and examples thereof include a fix electric furnace, a flow electric furnace, a rotary electric furnace, or a burner furnace, and a device using microwaves.

An amount of the resin layer in the carrier is preferably 0.01% by mass to 5.0% by mass. When the amount thereof is smaller than 0.01% by mass, a uniform resin layer may not be formed on a surface of a core material. When the amount thereof is greater than 5.0% by mass, a thickness of the resin layer becomes excessively thick so that a plurality of carrier particles may form into one particle, and therefore uniform carrier particles cannot be obtained.

In the case where the developer is a two-component developer, an amount of the carrier in the two-component developer is appropriately selected depending on the intended purpose without any limitation, but it is preferably 90% by mass to 98% by mass, more preferably 93% by mass to 97% by mass.

(Toner Container)

The toner container of the present invention contains a container and the toner of the present invention housed in the container.

The container of the toner container is appropriately selected from those known in the art without any limitation, and examples thereof include a container having a developer container main body and a cap. The size, shape, structure and material of the developer container main body are appropriately selected depending on the intended purpose without any limitation. The shape of the developer container main body is, for example, preferably a cylinder, and particularly preferably a configuration of the container main body, in which recess (a convexoconcave shape) is spirally formed in the internal circumference surface to thereby enable the content, that is the toner, to move to the side of the discharging outlet by rotation of the container main body, and the part of or entire spiral recess section functions as bellows. A material of the developer container main body is not particularly limited, but it is preferably selected from materials that are excellent in dimensional accuracy on the production. Preferable examples thereof include resins. Among them, for example, a polyester resin, a polyethylene resin, a polypropylene resin, a polystyrene resin, a polyvinyl chloride resin, polyacrylic acid, a polycarbonate resin, an ABS resin, a polyacetal resin are preferable. The developer container is easy to store and transport, excellent in handling, and can be suitably used in the process cartridge mentioned later to supply a developer by detachably mounting the developer container therein.

(Image Forming Apparatus and Image Forming Method)

The image forming apparatus of the present invention contains at least a latent electrostatic image bearing member, a latent electrostatic image forming unit, a developing unit, a transferring unit, and a fixing unit, and may further contain other units, such as a diselectrification unit, a cleaning unit, a recycling unit, and a controlling unit, if necessary.

The image forming method of the present invention contains at least a latent electrostatic image forming step, a developing step, a transferring step, and a fixing step, and may further contain other steps, such as a diselectrification step, a cleaning step, a recycling step, and a controlling step, if necessary.

The image forming method of the present invention can be suitably carried out by means of the image forming apparatus of the present invention; the latent electrostatic image forming step can be carried out by the latent electrostatic image forming unit; the developing step can be carried out by the developing unit; the transferring step can be carried out by the transferring unit; the fixing step can be carried out by the fixing unit; and the aforementioned other steps can be carried out by the aforementioned other units.

<Latent Electrostatic Image Forming Step and Latent Electrostatic Image Forming Unit>

The latent electrostatic image forming step is forming a latent electrostatic image on a latent electrostatic image bearing member.

A material, shape, structure, and size of the latent electrostatic image bearing member (may be referred to as a "photoconductor" hereinafter) are appropriately selected from those known in the art without any limitation. Examples of the latent electrostatic image bearing member include: an inorganic photoconductor of amorphous silicon, selenium, or the like; and an organic photoconductor of polysilane, phthalopolymethine, or the like. Among them, the amorphous silicon is preferable as it contributes to long service life of the resulting photoconductor. Examples of the shape of the latent electrostatic image bearing member include a drum shape, a sheet shape, and an endless belt shape. The structure of the latent electrostatic image bearing member may be a single layer structure or a multilayer structure. The size of the latent electrostatic image bearing member is appropriately selected depending on the intended purpose without any limitation, and it can be appropriately selected depending on the size and specification of the image forming apparatus.

As for the amorphous silicon photoconductor, for example, a photoconductor having a photoconductive layer formed of a-Si (may also referred to as an "a-Si photoconductor" hereinafter), obtained by heating a substrate to 50° C. to 400° C., followed by forming the photoconductive layer on the substrate by a film forming method such as vacuum deposition, sputtering, ion plating, thermal CVD, photo CVD, and plasma CVD, can be used. Among them, the plasma CVD, i.e., a method where raw material gas is decomposed by DC, or high frequency microwave glow discharge, to deposit a-Si film on the substrate, is preferable.

The formation of the latent electrostatic image can be performed, for example, by after charging a surface of the latent electrostatic image bearing member, exposing to light imagewise, and can be performed by means of the latent electrostatic image forming unit.

The latent electrostatic image forming unit contains, for example, at least a charging unit configured to charge a surface of the latent electrostatic image bearing member, and an exposing unit configured to expose the surface of the latent electrostatic image bearing member to light image wise.

—Charging Unit—

The charging can be performed, for example, by applying voltage to a surface of the latent electrostatic image bearing member by means of the charging unit.

The charging unit is appropriately selected depending on the intended purpose without any limitation, and examples thereof include: conventional contact charging units equipped with an electric conductive or semiconductive roller, brush, film or rubber blade; and non-contact chargers utilizing corona discharge such as corotron, and scorotron.

The shape of the charging unit may be in shape of a magnetic brush or fur brush, other than the roller, and the shape thereof can be appropriately selected depending on the specification and configuration of the image forming apparatus.

In the case where a magnetic brush is used as the charging unit, for example, the magnetic brush using various ferrite particles such as Zn—Cu ferrite is used as a charging unit, and the magnetic brush is constructed of these ferrite particles, a non-magnetic electric conductive sleeve for supporting the ferrite particles, and a magnet roller provided inside the sleeve.

In the case where the fur brush is used as the charging unit, as for a material of the fur brush, for example, a conductive-processed fur with carbon, copper sulfide, metal or metal oxide is used, and the process fur is formed into a charging unit by winding the fur around a core bar, which is formed of a metal or is conductive processed in other manners.

The charging unit is not limited to the contact charging unit, but the use of the contact charging unit is preferable as an image forming apparatus whose a generating amount of ozone is reduced is attained.

—Exposing Unit—

The exposing can be performed, for example, by exposing a surface of the latent electrostatic image bearing member to light imagewise by means of the exposing unit.

The exposing unit is appropriately selected depending on the intended purpose without any restriction, provided that it can expose the charged surface of the latent electrostatic image bearing member by the charging unit to light imagewise corresponding to an image to be formed. Examples thereof include various exposing devices, such as a reproduction optical exposing device, a rod-lens array exposing device, a laser optical exposure device, and a liquid crystal shutter optical device.

A light source used in the exposing unit is appropriately selected depending on the intended purpose without any limitation, and examples thereof include all luminous bodies such as fluorescent lamps, tungsten lamps, halogen lamps, mercury lamps, sodium lamps, light emitting diode (LED), laser diode (LD) (i.e. a semiconductor laser), and electroluminescence (EL).

Moreover, various filters may be used for applying only the light having the predetermined wavelength, and such examples of the filters include a sharp-cut filter, a band-pass filter, a near IR-cut filter, a dichroic filter, an interference filter, and a color conversion filter.

The method of the present invention can also employ a back light system where the imagewise exposing is performed from the back side of the latent electrostatic image bearing member.

<Developing Step and Developing Unit>

The developing step is developing the latent electrostatic image with the toner or developer containing the toner to form a visible image.

The aforementioned toner is the toner of the present invention.

The aforementioned developer is the developer of the present invention.

The formation of the visible image can be performed, for example, by developing the latent electrostatic image with the toner or developer containing the toner by means of the developing unit.

The developing unit is not particularly restricted, and can be appropriately selected from the conventional developing units, as long as it is capable of performing development using the toner or developer containing the toner. For example, a developing unit having at least a developing device housing the toner or developer containing the toner, and capable of applying the toner or developer containing the toner to the latent electrostatic image in a contact or non-contact manner is preferably used.

The developing device may be employ a dry developing system, or wet developing system, and may be a developing device for a singly color, or a developing device for a multi-color. Preferable examples of the developing device include a device having a stirrer configured to charge the toner or developer by frictions from stirring, and a rotatable magnetic roller.

In the developing device, for example, the toner and the carrier are mixed and stirred, and the toner is charged by the friction from the stirring. The charged toner is held on the surface of the rotatable magnetic roller in the form of a brush to form a magnetic brush. The magnetic roller is provided adjacent to the latent electrostatic image bearing member, part of the toner forming the magnetic brush on the surface of the magnetic roller is moved to the surface of the latent electrostatic image bearing member by electrical attraction force. As a result, the latent electrostatic image is developed with the toner to form a visible image on the surface of the latent electrostatic image bearing member.

The developed housed in the developing unit is the developer containing the toner, and the developer may be a one-component developer, or two-component.

As for the developing unit for the one-component developer, for example, a one-component developing device containing a developer bearing member to which the toner is supplied, and a layer thickness regulating member configured to form a thin layer of the toner on a surface of the developer bearing member, is preferable.

<Transferring Step and Transferring Unit>

The transferring step is appropriately selected depending on the intended purpose without any limitation, provided that it contains transferring the visible image onto a recording medium. For example, the transferring step is carried out by means of the transferring unit.

The transferring unit may be a transferring unit configured to transfer the visible image on the latent electrostatic image bearing member directly to a recording medium, or a secondary transferring unit using an intermediate transfer member, and configured to secondary transfer the visible image to a recording medium, after primary transferring the visible image on the intermediate transfer member.

The transferring can be performed, for example, by charging the latent electrostatic image bearing member, on which the visible image has been formed, by means of a transfer charging device, and this can be performed by the transferring unit. The transferring unit preferably contains a primary transferring unit configured to transfer the visible image onto an intermediate transfer member to form a composite transfer image, and a secondary transferring unit configured to transfer the composite transfer image onto a recording medium.

In the case where the image secondary transferred to the recording medium is a color image formed of a plurality of colors of the toners, the toner of each color is successively superimposed on the intermediate transfer member by the transferring unit to form an image on the intermediate transfer member, and the image formed on the intermediate transfer member is transferred to a recording medium at once by the intermediate transferring unit.

Note that, the intermediate transfer member is appropriately selected from conventional transfer members depending on the intended purpose without any restriction, but it is preferably a transfer belt.

The transferring unit (the primary transferring unit, the secondary transferring unit) preferably contains at least a transfer device configured to charge the visible image formed on the latent electrostatic image bearing member to release the visible image from the photoconductor to the side of the recording medium. The number of the transfer devices equipped may be 1, or 2 or more. Examples of the transfer device include a corona transfer device utilizing corona discharge, a transfer belt, a transfer roller, a pressure transfer roller, and an adhesion transfer member.

The transferring unit mentioned above is also suitably used in a tandem image forming apparatus.

The tandem image forming apparatus is an image forming apparatus in which a plurality of image forming units, each containing at least a latent electrostatic image bearing member, a charging unit, a developing unit, and a transferring unit, are aligned. This tandem image forming apparatus is equipped with four image forming units, of yellow, magenta, cyan, and black, and the four image forming units form visible images of respective colors in parallel, followed by laminating the resulting images on a recording medium or an intermediate transfer member. Accordingly, a full color image can be formed at high speed by means of the tandem image forming apparatus.

Figure 5:
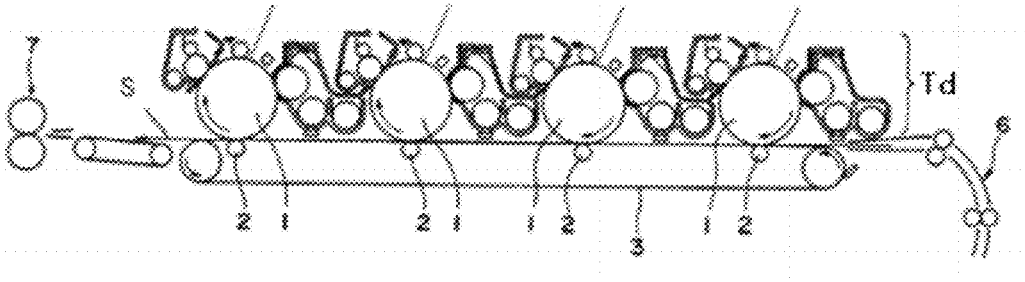
FIG. 5 is a schematic cross-sectional view illustrating one example of the image forming apparatus (tandem image forming apparatus) of a direct transfer system according to the present invention.
Figure 6:
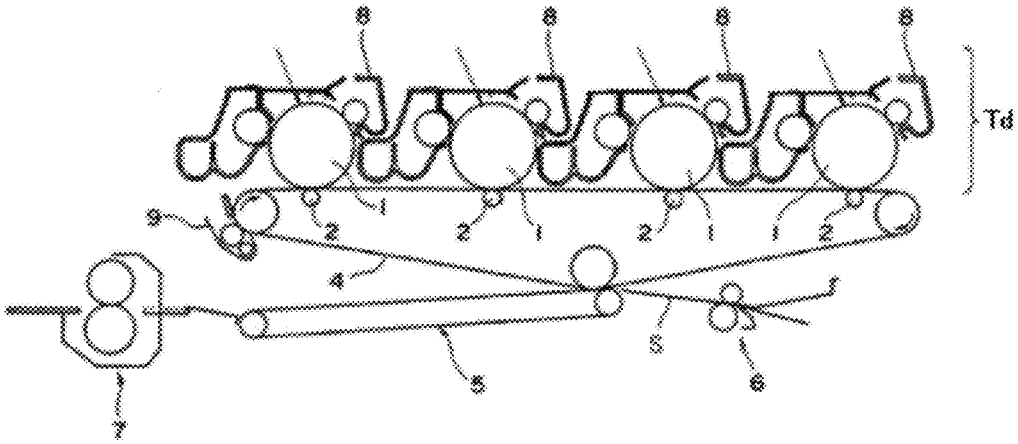
FIG. 6 a schematic cross-sectional view illustrating one example of the image forming apparatus (tandem image forming apparatus) of an indirect transfer system according to the present invention.

The tandem image forming apparatus is classified into (1) a direct transfer system, as illustrated in FIG. 5, in which a visible image formed on each electrostatic image bearing member 1 is successively transferred to a recording medium S, by a transferring unit 2, where the recording medium S is transported by a transporting belt 3 in the manner that the recording medium S passes through a transfer portion which is the region facing each latent electrostatic image bearing member 1 of each image forming unit, and (2) an indirect transfer system, as illustrated in FIG. 6, in which visible images formed on latent electrostatic image bearing members 1 of the image forming units are sequentially transferred to an intermediate transfer member 4 temporally, by a transferring unit (primary transferring unit)$_2$, followed by transferring the images on the intermediate transfer member 4 to a recording medium S at once by means of a secondary transferring unit 5. Note that, the transfer convey belt is used as the secondary transferring unit in FIG. 6, but the secondary transferring unit may be in the form of a roller.

Comparing the (1) direct transfer system with the (2) indirect transfer system, in the (1) direct transfer system, a paper feeding device 6 is arranged upstream of a tandem image forming unit Td, in which latent electrostatic image bearing members 1 are aligned, and a fixing device 7 as the fixing unit is arranged downstream of the tandem image forming unit Td, therefore, the size of the image forming apparatus becomes large in the direction along the transporting direction of the recording medium. By contrast, in the (2) indirect transfer system, a secondary transfer position can be relatively freely arranged, and therefore the paper feeding device 6 and fixing device 7 can be arranged to be underneath the tandem image forming unit Td, which is advantages in terms of down sizing the apparatus.

To prevent the image forming apparatus of the (1) direct transfer system from increasing its size in the direction along the transporting direction of the recording medium, the fixing device 7 is arranged to come close to the tandem image forming unit Td. Accordingly, the fixing device 7 cannot be arranged to give a sufficient space for the recording medium S to be bent, so that the fixing device 7 largely affects the upper stream side of the image formation operation, because of the impact when an edge of the recording medium S enters the fixing device 7 (which is significant especially with a thick recording medium), or a difference in the speed between the transporting speed of the recording medium when it passes the fixing device 7, and the speed of the recording medium conveyed by a transfer conveying belt. Contrary, in the (2) indirect transfer system, the fixing device 7 can be arranged to give a sufficient space for the recording medium S to be bent, and therefore the fixing device 7 hardly affects the image formation.

Because of the aforementioned reasons, currently image forming apparatuses especially of the indirect transfer system have been popular. In a color image forming apparatus of such a system, as illustrated in FIG. 6, the toner remained on a latent electrostatic image bearing member 1 after primary transfer is removed by a cleaning device 8 serving as a cleaning unit to clean a surface of the latent electrostatic image bearing member 1, which is then ready for another operation of image formation. Moreover, the toner remained on an intermediate transfer member 4 after secondary transfer is removed by an intermediate transfer member cleaning device 9 to clean a surface of the intermediate transfer member 4, which is then ready for another operation of image formation.

The recording medium is typically plain paper, but it is appropriately selected depending on the intended purpose without any limitation, provided that a developed unfixed image can be transferred thereon. A PET base for OHP can also be used as the recording medium.

<Fixing Step and Fixing Unit>

The fixing step is fixing the transferred visible image onto the recording medium. In this step, fixing may be performed every time when an image formed of the toner of each color is transferred onto the recording medium. Alternatively, fixing may be performed after the toners of all the colors are transferred to the recording medium in a laminated state.

The fixing step can be carried out by the fixing unit.

The fixing unit is appropriately selected depending on the intended purpose without any limitation, but it is preferably a fixing unit containing a fixing member and a heater for heating the fixing member.

The fixing member is appropriately selected depending on the intended purpose without any limitation, provided that a combination thereof can form a nip by contacting to each other. Examples thereof include a combination of an endless belt and a roller, and a combination of a roller and a roller. Among them, the fixing member is preferably a combination of an endless belt and a roller, or using a heating method of induction heating a surface of the fixing member, in view of reduction in the duration for warming up, and energy saving.

The fixing member moreover includes a conventional heating and pressurizing member (a combination of a heating member and a pressurizing member).

In case of the heating and pressurizing member formed of a combination of the endless belt and the roller, examples of the heating and pressurizing member include a combination of a heating roller, a pressurizing roller, and an endless belt. In the case of the heating and pressurizing member formed of a combination of the roller and the roller, examples of the heating ad pressurizing member include a combination of a heating roller and a pressurizing roller.

In the case where the fixing member is an endless belt, the endless belt is preferably formed of a material having a small thermal capacity. Examples thereof include an embodiment in which an anti-offset layer is provided on a support.

Examples of a material for forming the support include nickel, and polyimide.

Examples of a material for forming the anti-offset layer include silicone rubber, and a fluororesin.

In the case where the fixing member is a roller, a core of the roller is preferably formed of an inelastic member for preventing the deformation (deflection) of the roller by high pressure.

The inelastic member is appropriately selected depending on the intended purpose without any limitation, but it is preferably a high thermal conductive material such as aluminum, iron, stainless steel, and brass.

A surface of the roller is preferably covered with an anti-offset layer.

A material for forming the anti-offset layer is appropriately selected depending on the intended purpose without any limitation, and examples thereof include RTV (Room Temperature Vulcanization) silicone rubber, tetrafluoroethylene-perfluoroalkylvinyl ether (PFA), and polytetrafluoroethylene (PTFE).

In the fixing step, the toner image may be fixed on the recording medium by transferring the toner image to the recording medium, and passing the recording medium, onto which the image has been transferred, through the nip. Alternatively, transferring and fixing of the image to the recording medium may be simultaneously performed at the nip.

The fixing step may be performed on the toner of each color every time when the toner image thereof is transferred to the recording medium, or may be performed once on the laminate of toner images of all the colors used.

The nip is formed by contacting at least two fixing member constituting elements (e.g., the endless belt with the roller, and the roller with the roller) to each other.

The bearing at the nip is appropriately selected depending on the intended purpose without any limitation, provided that it is the bearing with which the capsules can be fractured. The bearing is preferably 1 MPa or greater, more preferably 1 MPa to 5 MPa, and even more preferably 1 MPa to 2 MPa. When the bearing at the nip is excessively high, the durability of the roller reduces, which lead to an increase in weight and size of the fixing unit.

The temperature for fixing the toner image on the recording medium (i.e., the surface temperature of the fixing member) is the temperature at which the effective temperature of the toner layer (the toner transferred on the recording medium) becomes 40° C. to 50° C. Such fixing temperature is preferably 50° C. to 70° C., more preferably 50° C. to 60° C. in view of heat loss to the unfixed image carrier, such as paper.

In the case where a plasticizer that is a solid at ordinary temperature is used as the plasticizer, moreover, the fixing temperature is preferably the temperature at which the plasticizer in the toner subjected to the fixing step becomes a liquid.

The fixing unit is roughly classified into a (1) embodiment where a fixing unit contains a roller and/or a belt, heating is performed from a surface with which the toner is not in contact, and the image transferred on the recording medium is heated and pressurized to be fixed (internal heating system), and a (2) embodiment where a fixing unit contains a roller and/or a belt, heating is performed from a surface with which the toner is in contact, and the image transferred on the recording medium is heated and pressurized to be fixed (external heating system). Note that, it is possible to use a combination of these systems.

Examples of the fixing unit of the (1) internal heating system include a fixing member containing a heating unit inside thereof. Examples of the heating unit include a heat source such as heater, and a halogen lamp.

As for the fixing unit of the (2) external heating system, for example, an embodiment where at least part of at least one surface of the fixing member is heated by a heating member is preferable. The heating member is appropriately selected depending on the intended purpose without any limitation, and examples thereof include a unit of an electromagnetic induction heating system.

The unit of the electromagnetic induction heating system is appropriately selected depending on the intended purpose without any limitation, but it is preferably the unit containing a magnetic field generating unit, and an electromagnetic induction heating unit.

As for the unit of the electromagnetic induction heating system, for example, a fixing unit, which contains an induction coil provided adjacent to the fixing member (e.g., a heating roller), a shielding layer to which the induction coil is provided, and an insulating layer provided to the side opposite to the surface where the induction coil of the shielding layer is provided, is preferable. In such the unit, the heating roller is preferably an embodiment where it is formed of a magnetic material or an embodiment where it is a heat pipe.

The induction coil is preferably provided in the state that it covers at least a semi-cylindrical portion at the side of the heating roller opposite to the side of the contact area between the heating roller and the fixing member (e.g., a heating roller, and an endless belt).

—Fixing Unit of Internal Heating System—

Figure 7:
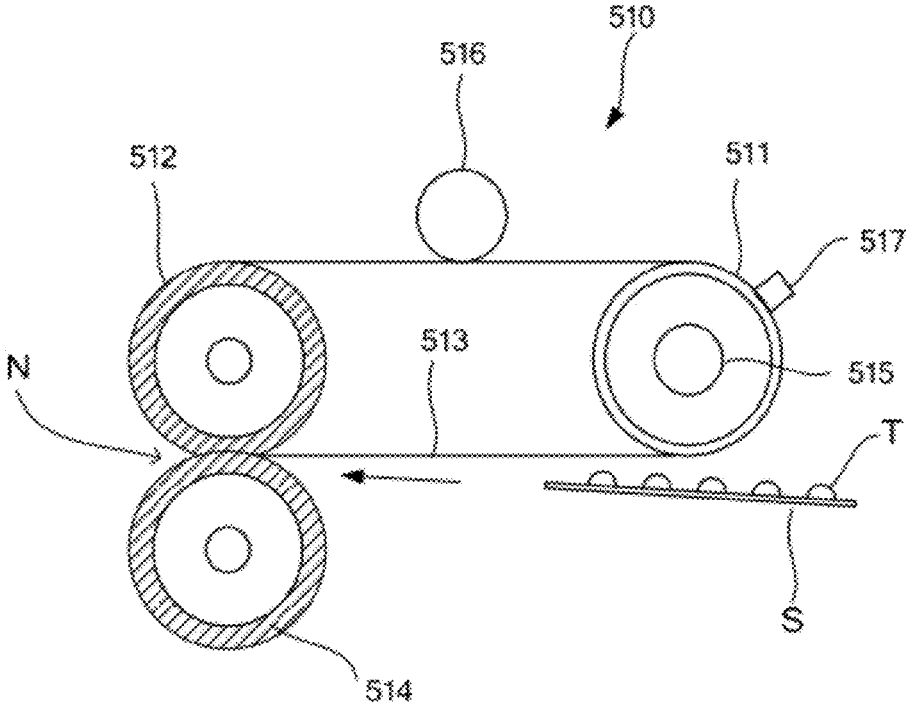
FIG. 7 is a schematic cross-sectional view illustrating one example of a fixing unit of a belt system for use in the image forming apparatus of the present invention.

FIG. 7 illustrates a belt fixing device, which is one example of the fixing unit of the internal heating system. The belt fixing device 510 of FIG. 7 is equipped with a heating roller 511, a fixing roller 512, a fixing belt 513, and a pressurizing roller 514.

The fixing belt 513 is supported by the heating roller 511 and the fixing roller 512, both of which are rotatably disposed inner side of the fixing belt 513, and the fixing belt 513 is heated to a certain temperature by the heating roller 511. The heating roller 511 has a heat source 515 therein, and is designed so that the temperature thereof can be controlled by a temperature sensor 517 provided adjacent to the heating roller 511. The fixing roller 512 is rotatably provided inner side of the fixing belt 513 in the state that it is in contact with the inner surface of the fixing belt 513. The pressurizing roller 514 is rotatably provided outer side of the fixing belt 513 in the state that the outer surface of the fixing belt 513 is brought into contact with the fixing roller 512 with pressure. The surface hardness of the fixing belt 513 is lower than the surface hardness of the pressurizing roller 514, and at the nip N formed between the fixing roller 512 and the pressurized roller 514, the intermediate region located between the inlet end and outlet end of the recording medium S is located to the side of the fixing roller 512 (the pressurized roller pushes into the fixing roller), compared to the positions of the inlet end and outlet end.

In the belt fixing device 510 illustrated in FIG. 7, the recording medium S, onto which a toner image T to be fixed has been formed, is transported to the position of the heating roller 511. Then, the toner image T on the recording medium S is heated by the heating roller 511 and the fixing belt 513, which has been heated to certain temperature by the function of the heat source 515 built in the heating roller 511, to thereby form the toner into the fused state. With the toner of this state, the recording medium S is introduced to the nip N formed between the fixing roller 512 and the pressurized roller 514. The recording medium S introduced to the nip is brought into contact with a surface of the fixing belt 513, which is rotated that is linked with the rotations of the fixing roller 512 and the pressurized roller 514. The recording medium S is compressed as it passes through the nip, and as a result, the toner image T is fixed onto the recording medium S.

Subsequently, the recording medium S onto which the toner image T has been fixed is passed through the nip between the fixing roller 512 and the pressurized roller 514, separated from the fixing belt 513, and then transported to a tray (not illustrated). The recording medium S is output in the direction towards the side of the pressurized roller 514, to thereby prevent the recording medium S from wrapping around the fixing belt 513. Note that, the fixing belt 513 is cleaned by a cleaning roller 516.

—Fixing Unit of External Heating System—

Figure 8:
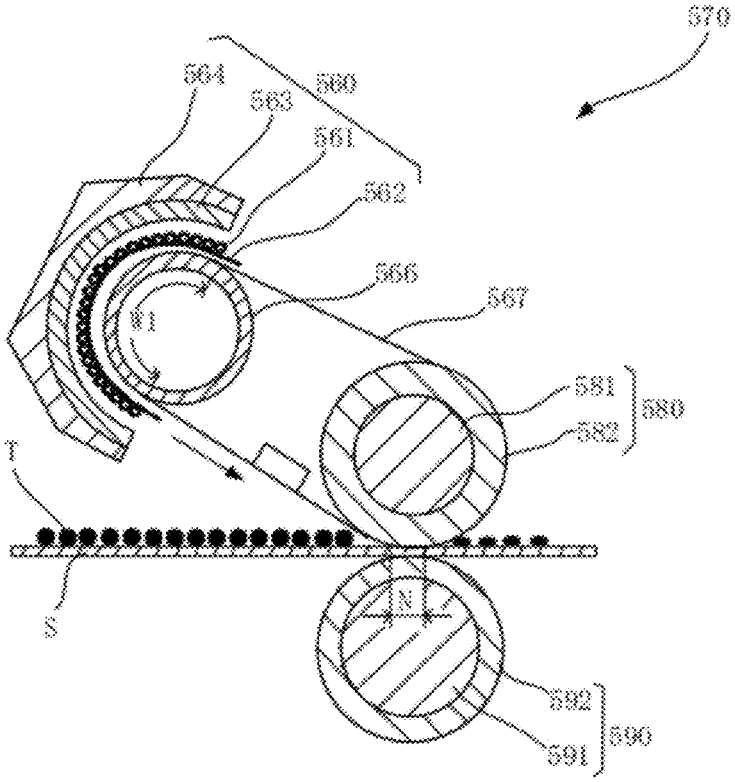
FIG. 8 is a schematic cross-sectional view illustrating one example of a fixing unit of an electromagnetic induction heating system system for use in the image forming apparatus of the present invention.

FIG. 8 illustrates a fixing device of an electromagnetic induction heating system 570, which is one example of the fixing unit of the external heating system. The fixing device of the electromagnetic induction heating system 570 is equipped with a heating roller 566, a fixing roller 580, a fixing belt 567, a pressurized roller 590, and an electromagnetic induction heating system unit 560.

The fixing belt 567 is supported by the heating roller 566 and the fixing roller 580, both of which are rotatably disposed at the inner side of the fixing belt, and the fixing belt 567 is heated to certain temperature by the heating roller 566.

The heating roller 566 has a hollow cylindrical magnetic metal member formed, for example, of iron, cobalt, nickel, or an alloy thereof. For example, the heating roller 566 is designed to have an outer diameter of 20 mm to 40 mm, and a wall thickness of 0.3 mm to 1.0 mm, and has a structure of a low heat capacity and high rate of temperature increase.

The fixing roller 580 contains, for example, a metal core 581 of stainless steel or the like, and a surface of the metal core 581 is covered with an elastic layer 582 formed by solidifying or foaming thermal resistant silicone rubber. The fixing roller 580 is rotatably disposed at the inner side of the fixing belt 567 in the state that it is in contact with the inner surface of the fixing belt 567. The fixing roller 580 is designed to have an inter diameter of about 20 nm to about 40 nm, which is larger than that of the heating roller 566, for forming a certain width of the nip N between the pressurizing roller 590 and the fixing roller 580 by the pressure from the pressurized roller. In addition, the fixing roller 580 is designed so that the elastic layer 582 has a thickness of about 4 mm to about 6 mm and the heat capacity of the heating roller 566 is smaller than the heat capacity of the fixing roller 580 to thereby reduce the warm-up time of the heating roller 566.

The pressurized roller 590 contains, for example, a core 591, which is a cylindrical member formed for a high heat conductive metal such as copper, and aluminum. A surface of the core is covered with an elastic layer 592 having high heat resistant property and toner releasing property. The pressurized roller 590 is rotatably disposed at the outer side of the fixing belt 567 so that the outer surface of the fixing belt 567 is brought into contact with the fixing roller 580 with pressure. Note that, other than the metals mentioned above, SUS may be used for the core 591.

The electromagnetic induction heating system unit 560 is provided adjacent to the heating roller 566 to cover the heating roller 566 along the axial direction thereof. The electromagnetic induction heating system unit 560 contains an excitation coil 561, which is a magnetic field generating unit, and a coil guide plate 562 around which the excitation coil 561 has been wound. The coil guide plate 562 is provided adjacent to the outer circumferential surface of the heating roller 566, and is in the shape of a semi-cylinder. The excitation coil 561 is a coil formed by alternately winding one long excitation coil wire around the coil guide plate 562 along the axial direction of the heating roller 566. Note that, the excitation coil 561 is connected to a driving power source (not illustrated) whose oscillation circuit can vary its frequency. At the outer side of the excitation coil 561, a semi-cylindrical excitation coil core 563 formed of a hard magnetic material such as ferrite is fixed to an excitation coil core supporting member 564, and is provided adjacent to the excitation coil 561.

<Diselectrification Step and Diselectrification Unit>

The diselectrification step is applying diselectrification bias to the latent electrostatic image bearing member to diselectrify the photoconductor, and the diselectrification step can be suitably carried out by a diselectrification unit.

The diselectrification unit is appropriately selected from conventional diselectrification units known in the art without any limitation, provided that it is capable of applying diselectrification bias to the latent electrostatic image bearing member. As for the diselectrification unit, for example, a diselectrification lamp is preferable.

<Cleaning Step and Cleaning Unit>

The cleaning step is removing the residual toner on the latent electrostatic image bearing member, and the cleaning step can be suitably performed by a cleaning unit. Note that, it is also possible to use a method where the residual toner is charged to have the same polarity by a friction member and then collected by a developing roller, without using the cleaning unit.

The cleaning unit is appropriately selected from cleaners known in the art without any limitation, provided that it is capable of removing the toner remained on the latent electrostatic image bearing member. Preferable examples thereof include a magnetic brush cleaner, an electrostatic brush cleaner, a magnetic roller cleaner, a blade cleaner, a brush cleaner, and a web cleaner.

<Recycling Step and Recycling Unit>

The recycling step is recycling the toner removed in the cleaning step to the developing unit, and the recycling can be suitably carried out by a recycling unit. The recycling unit is not particularly limited, and examples thereof include conventional conveying units.

<Controlling Step and Controlling Unit>

The controlling step is controlling operations of each step, and can be suitably carried out by a controlling unit.

The controlling unit is appropriately selected depending on the intended purpose without any limitation, provided that it is capable of controlling the operations of each step. Examples thereof include devices such as a sequencer, and a computer.

The image forming apparatus is preferably an image forming apparatus containing a process cartridge in which the latent electrostatic image bearing member and at least the developing unit are integratedly supported, where the process cartridge is detachably mounted to the image forming apparatus.

<Image Forming Apparatus and Image Forming Method>

One embodiment for carrying out the image forming method of the present invention by the image forming apparatus of the present invention will be explained with reference to FIG. 9, hereinafter. An image forming apparatus 100 illustrated in FIG. 9 is equipped with a latent electrostatic image bearing member 10, which is a photoconductor drum, a charging roller 20 serving as the charging unit, exposure light L emitted from an exposure device serving as the exposing unit, a developing device 40 serving as the developing unit, an intermediate transfer member 50, a cleaning unit 60, and a diselectrification lamp 70 serving as the diselectrification unit.

The intermediate transfer member 50 is an endless belt, and is designed to rotate in the direction indicated with an arrow by three rollers 51 disposed inside the intermediate transfer member 50 to support the intermediate transfer member 50. Part of the three rollers 51 also functions as a transfer bias roller capable of applying a predetermined transfer bias (primary transfer bias) to the intermediate transfer member 50. In the surrounding area of the intermediate transfer member 50, the cleaning device 90 for the intermediate transfer member is provided, and the transfer roller 80 serving as the transferring unit capable of applying a transfer bias for transferring (secondary transferring) a developed image (i.e. the toner image) to a recording medium 95 is provided to face the intermediate transfer member 50. In the surrounding area of the intermediate transfer member 50, the corona charger 58, which is configured to apply a charge to the toner image on the intermediate transfer member 50, is provided in the area situated between the contact area of the latent electrostatic image bearing member 10 and the intermediate transfer member 50, and the contact area of the intermediate transfer member 50 and the recording medium 95, in the rotation direction of the intermediate transfer member 50.

The developing device 40 consists of a developing belt 41 serving as the developer bearing member, and a black developing unit 45K, a yellow developing unit 45Y, a magenta developing unit 45M, and a cyan developing unit 45C, which are provided next to the developing belt 41. The black developing unit 45K is equipped with a developer-retention section 42K, a developer supply roller 43K, and a developing roller 44K. The yellow developing unit 45Y is equipped with a developer-retention section 42Y, a developer supply roller 43Y, and a developing roller 44Y. The magenta developing unit 45M is equipped with a developer-retention section 42M, a developer supply roller 43M, and a developing roller 44M. The cyan developing unit 45C is equipped with a developer-retention section 42C, a developer supply roller 43C, and a developing roller 44C. Moreover, the developing belt 41 is an endless belt, which is rotatably supported by a plurality of belt rollers, and at part of which is in contact with the latent electrostatic image bearing member 10.

Figure 9:
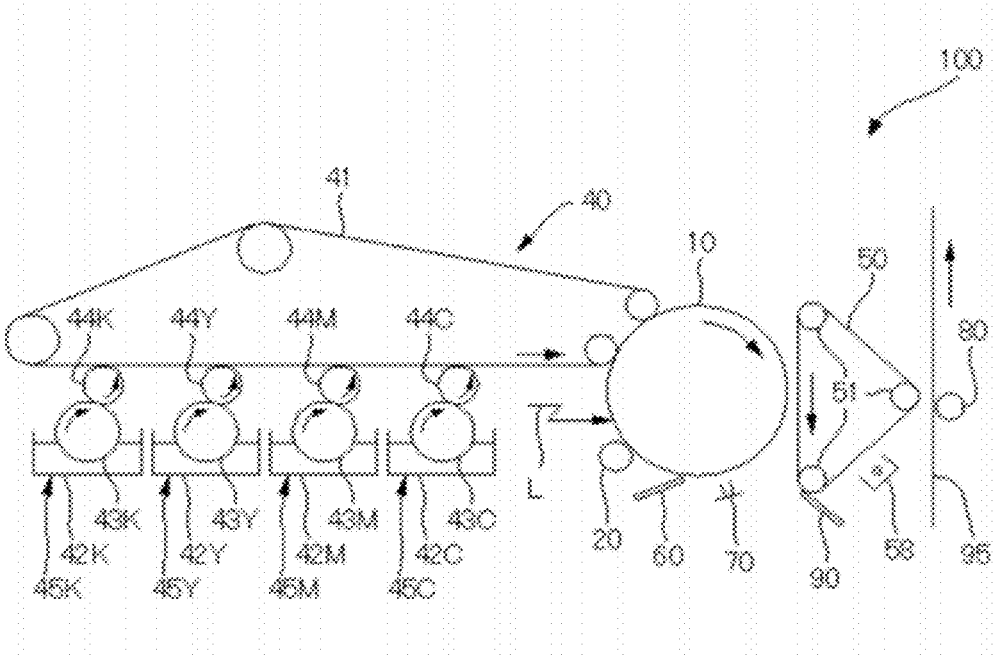
FIG. 9 is a schematic cross-sectional view illustrating one example of the image forming apparatus of the present invention.

In the image forming apparatus 100 of FIG. 9, first, the charging roller 20 uniformly charges the latent electrostatic image bearing member 10. The exposing device (not illustrated) applies light L onto the latent electrostatic image bearing member 10 imagewise to perform exposure to thereby form a latent electrostatic image thereon. The latent electrostatic image formed on the latent electrostatic image bearing member 10 is developed with a toner supplied from the developing device 40 to thereby form a visible image. The visible image is transferred (primary transferred) onto the intermediate transfer member 50 by the voltage applied by the roller 51, and is then transferred (secondary transferred) onto the recording medium 95. As a result, a transfer image is formed on the recording medium 95. Note that, the residual toner on the latent electrostatic image bearing member 10 is removed by the cleaning blade 60, and the charge of the latent electrostatic image bearing member 10 is temporarily removed by the diselectrification lamp 70.

Figure 10:
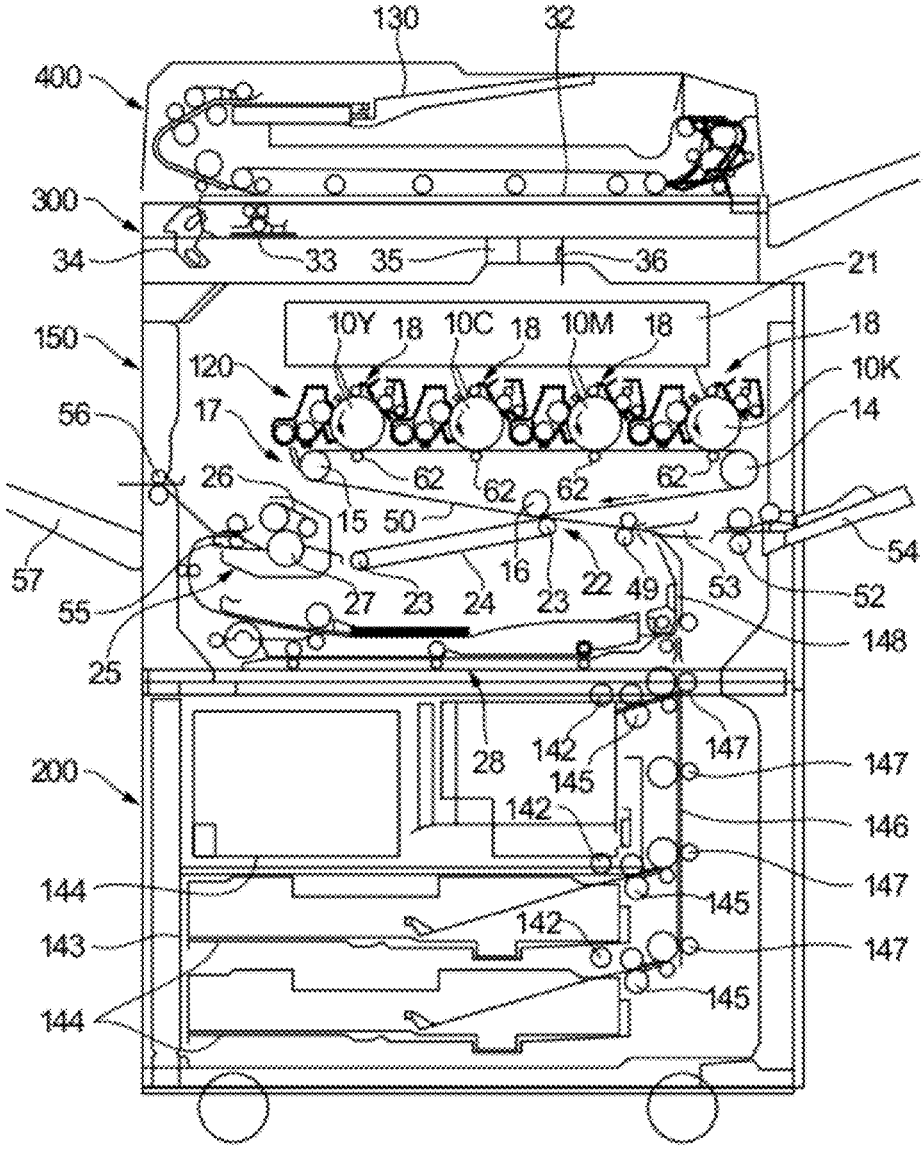
FIG. 10 is a schematic cross-sectional view illustrating another example of the image forming apparatus of the present invention.

Another embodiment for carrying out the image forming method of the present invention by the image forming apparatus of the present invention will be explained with reference to FIG. 10. A tandem-type image forming apparatus illustrated in FIG. 10 is a tandem-type color image forming apparatus. This tandem-type color image forming apparatus is equipped with an apparatus main body 150, a feeding table 200, a scanner 300, and an automatic document feeder (ADF) 400.

In the central part of the apparatus main body 150, an intermediate transfer member 50 in the form of an endless belt is provided. The intermediate transfer member 50 is rotatably supported by support rollers 14, 15, and 16 in the clockwise direction in FIG. 10. In the surrounding area of the support roller 15, an intermediate transfer member cleaning unit 17 configured to remove the residual toner on the intermediate transfer member 50 is provided. To the intermediate transfer member 50 supported by the support roller 14 and the support roller 15, a tandem developing unit 120, in which four image forming units 18, i.e. yellow, cyan, magenta, and black image forming units, are aligned along the traveling direction of the intermediate transfer member 50, is provided. In the surrounding area of the tandem developing unit 120, an exposing device 21 is provided. A secondary transferring unit 22 is provided at the opposite side of the intermediate transfer member 50 to the side where the tandem developing unit 120 is provided. In the secondary transfer unit 22, a secondary transfer belt 24, which is an endless belt, is supported by a pair of rollers 23, and is designed so that a recording medium transported on the secondary transfer belt 24 and the intermediate transfer member 50 can be in contact with each other. In the surrounding area of the secondary transferring unit 22, a fixing device 25 is provided. The fixing device 25 is equipped with a fixing belt 26, and a pressure roller 27.

In the surrounding area of the secondary transferring unit 22 and the fixing device 25, a sheet reverser 28, which is configured to reverse the recording medium to perform image formation on both sides of the recording medium, is provided.

A method for forming a full-color image (i.e., color copying) using the tandem developing device 120 will be explained next. At first, a document is set on a document table 130 of the automatic document feeder (ADF) 400. Alternatively, the automatic document feeder (ADF) 400 is opened, a document is set on a contact glass 32 of the scanner 300, and then the ADF 400 is closed.

In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from a light source of the first carriage 33 is reflected on the surface of the document, the reflected light from the document is further reflected by a mirror of the second carriage 34, and passed through an image formation lens 35, which is then received by a read sensor 36. In this manner, the color document (color image) is read, and image information of black, yellow, magenta, and cyan is obtained.

Figure 11:
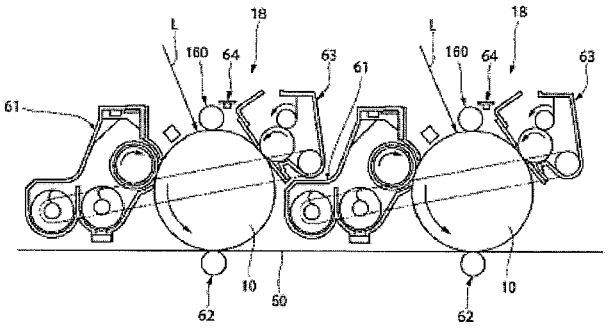
FIG. 11 is an enlarged view of each image forming unit of FIG. 10.

The image information of each color, black, yellow, magenta or cyan, is transmitted to respective image forming unit 18 (a black image forming unit, a yellow image forming unit, a magenta image forming unit, and a cyan image forming unit) of the tandem developing unit 120, and by each image forming unit, a respective toner image, i.e. of black, yellow, magenta, or cyan, is formed. Specifically, each image forming unit 18 (the black image forming unit, the yellow image forming unit, the magenta image forming unit, or the cyan image forming unit) of the tandem developing unit 120 is, as illustrated in FIG. 11, equipped with a latent electrostatic image bearing member 10 (black latent electrostatic image bearing member 10K, yellow latent electrostatic image bearing member 10Y, magenta latent electrostatic image bearing member 10M, and cyan latent electrostatic image bearing member 10C), a charging device 160 configured to uniformly charge the latent electrostatic image bearing member 10, an exposing device configured to expose the latent electrostatic image bearing member with light (L, illustrated in FIG. 11) imagewise corresponding to each color image based on the image information of each color to form a latent electrostatic image corresponding to the image of each color on the latent electrostatic image bearing member, a developing device 61 configured to develop the latent electrostatic image with a respective color toner (a black toner, a yellow toner, a magenta toner, or a cyan toner) to form a toner image of each color toner, a transfer charger 62 configured to transfer the toner image onto an intermediate transfer member 50, a cleaning device 63, and diselectrification unit 64. The image forming units can form single color images of respective color (a black image, a yellow image, a magenta image, and a cyan image) corresponding to the respective image information of respective color. The black image, yellow image, magenta image, and cyan image formed in this manner are transferred to the intermediate transfer member 50 rotatably supported by the support rollers 14, 15, and 16 in the following manner. Specifically, the black image formed on the black latent electrostatic image bearing member 10K, the yellow image formed on the yellow latent electrostatic image bearing member 10Y, the magenta image formed on the magenta latent electrostatic image bearing member 10M, and the cyan image formed on the cyan latent electrostatic image bearing member 10C are successively transferred (primary transferred) onto the intermediate transfer member 50. On the intermediate transfer member 50, the black image, the yellow image, the magenta image, and the cyan image are superimposed to form a composite color image (a color transfer image).

In the feeding table 200, one of the feeding rollers 142 is selectively rotated to a recording medium from one of multiple feeder cassettes 144 of a paper bank 143, the ejected recording mediums are separated one by one by a separation roller 145 to send to a feeder path 146, and then transported by a transport roller 147 into a feeder path 148 within the apparatus main body 150. The recording medium transported in the feeder path 148 is then bumped against a registration roller 49 to stop. Alternatively, recording mediums on a manual-feeding tray 54 are ejected by rotating a feeding roller 142, separated one by one by a separation roller 52 to guide into a manual feeder path 53, and then bumped against the registration roller 49 to stop. Note that, the registration roller 49 is generally earthed at the time of the use, but it may be biased for removing paper dust of the recording medium. Next, the registration roller 49 is rotated synchronously with the movement of the composite color image (color transfer image) superimposed on the intermediate transfer member 50, to thereby send the recording medium between the intermediate transfer member 50 and the secondary transferring unit 22. The composite color image (color transfer image) is then transferred (secondary transferred) to the recording medium by a secondary transferring unit 22, to thereby form the color image on the recording medium. Note that, after transferring the image, the residual toner on the intermediate transfer member 50 is cleaned by the intermediate transfer member cleaning device 17.

The recording medium on which the color image has been transferred is transported by a secondary transfer device 22 to send to a fixing device 25. In the fixing device 25, the composite color image (color transfer image) is fixed to the recording medium by heat and pressure. Thereafter, the recording medium is changed its traveling direction by a switch craw 55, ejected by an ejecting roller 56, and then stacked on an output tray 57. Alternatively, the recording medium is changed its traveling direction by the switch craw 55, reversed by the sheet reverser 28 to send to a transfer position, to thereby record an image on the back side thereof. Then, the recording medium is ejected by the ejecting roller 56, and stacked on the output tray 57.

(Process Cartridge)

The process cartridge of the present invention contains at least a latent electrostatic image bearing member, and a developing unit configured to develop, using the toner, a latent electrostatic image formed on the latent electrostatic image bearing member, to thereby form a visible image.

The process cartridge may further contain appropriately selected other units, such as a charging unit, an exposing unit, a transferring unit, a cleaning unit, and a diselectrification unit, if necessary.

The process cartridge is constructed, for example, as to equip the latent electrostatic image bearing member and developing unit integratedly.

The developing unit contains at least a developer container housing the toner or developer therein, and a developer bearing member configured to bear and transport the toner or developer housed in the developer container, and may further contain a layer thickness regulating member. Specifically, the one-component developing unit and two-component developing unit as explained in the descriptions of the image forming apparatus and image forming method can be suitably used.

The charging unit, exposing unit, transferring unit, cleaning unit, and diselectrification unit can be appropriately selected from those described in the section of the image forming apparatus above.

The process cartridge is detachably mounted in various electrophotographic image forming apparatuses, facsimiles, and printers. It is particularly preferred that the process cartridge be detachably mounted in the image forming apparatus of the present invention.

Figure 12:
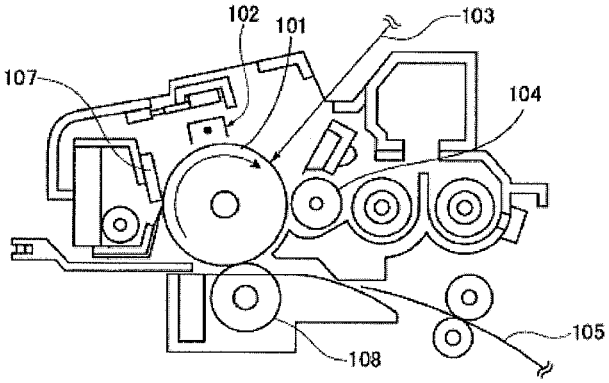
FIG. 12 is a schematic cross-sectional view illustrating one example of the process cartridge of the present invention.

As illustrated in FIG. 12, for example, the process cartridge contains therein a latent electrostatic image bearing member 101, and contains a charging unit 102, a developing unit 104, a transferring unit 108, and a cleaning unit 107, and may further contain other units, if necessary. In FIG. 12, 103 denotes exposure light emitted from an exposing unit, and 105 denotes a recording medium.

An image forming process by means of the process cartridge illustrated in FIG. 12 will be explained next. The latent electrostatic image bearing member 101 is charged by a charging unit 102 and exposed to exposure light 103 emitted from the exposing unit (not illustrated) with rotating the direction shown with the arrow, to thereby form a latent electrostatic image corresponding to the exposed image, on a surface thereof. The latent electrostatic image is developed by the developing unit 104 to form a visible image, the resulting visible image is transferred to a recording medium 105 by the transferring unit 108, followed by output. Subsequently, the surface of the latent electrostatic image bearing member, from which the image has been transferred, is cleaned by the cleaning unit 107, and diselectrified by the diselectrification unit (not illustrated). Then, the aforementioned operations are again performed.

EXAMPLES

Examples of the present invention will be explained hereinafter, but these examples shall not be construed as limiting the scope of the present invention in any way.

Example 1

Preparation of Capsules Encapsulating Plasticizer

Capsules each encapsulating lauric acid as a plasticizer and having a shell of polyvinyl alcohol were produced by coacervation. The preparation method is described below.

A beaker was charged with 100 mL of water (ion-exchanged water), a dispersant (a sorbitol-based surfactant, KAO TW120s, Kao Corporation) was added thereto in an amount of 2 parts by mass relative to 100 parts by mass of the water, and the resulting mixture was stirred to thereby dissolve the dispersant in the water. Thereafter, 1 part by mass of polyvinyl alcohol (Mw=500) powder was added thereto relative to 100 parts by mass of the water and was sufficiently dissolved therein, with maintaining the liquid temperature to 70° C. After dissolving the polyvinyl alcohol powder, powdery lauric acid (manufactured by Kanto Chemical Co., Inc., melting point: 44° C. to 46° C.) was added thereto in an amount of 1 part by mass relative to 100 parts by mass of the water, with maintaining the liquid temperature to 70° C., and stirring the aqueous solution in the beaker by means of an ultrasonic homogenizer (UT-300, manufactured by Nippon Seiki Co., Ltd.). The lauric acid started being dissolved just after the addition thereof, to proceed to emulsification (O/W emulsification). Under this condition, the mixture was kept stirred for 10 minutes. After the stirring, a stirring bar was placed in the beaker, ice cubes were placed around the beaker, and the resultant was stirred for 10 minutes at 300 rpm with quenching to 10° C. The emulsion of this stage was observed under a laser microscope, and numbers of solid lauric acid particles having the diameters of approximately 300 nm were observed. Next, to the aqueous dispersion liquid in which the lauric acid particles were dispersed, 50 mL of ethanol was added dropwise with stirring at 500 rpm, and the resulting aqueous dispersion in the beaker was stirred for 10 minutes. After the stirring, the resultant was separated into solids and a liquid by a centrifuge, and only the supernatant was discarded. The resultant was then mixed with ethyl acetate. This operation was repeatedly performed 10 times, to thereby obtain a liquid where the solid particles were dispersed in ethyl acetate. The cross-section of the obtained solid particles was observed under a transmission electron microscope (TEM), and it was found that the obtained solid particles were capsules having the diameters of 300 nm, each having a shell of polyvinyl alcohol, and encapsulating lauric acid.

<Production of Toner>

A styrene-butadiene-styrene copolymer (SBS, ASAPRENE T432, manufactured by Asahi Kasei Corp.) serving as a thermoplastic elastomer was added to ethyl acetate in an amount of 20 parts by mass relative to 80 parts by mass of the ethyl acetate, and dissolved therein. To this SBS ethyl acetate solution (concentration of SBS: 20% by mass), the above-prepared dispersion liquid in which the capsules were dispersed in the ethyl acetate was added in an amount that the amount of the capsules was to be 3 parts by mass relative to 20 parts by mass of the SBS, and the resultant was stirred for 3 minutes at 100 rpm. This series of the mixing operations were performed in the environment of 20° C. To the ethyl acetate solution in which the SBS and the capsules were mixed, 10% by mass of polystyrene (PICCOLASTIC A-75, manufactured by Eastman Chemical Company) and 10% by mass of a carbon black master batch were added relative to the total solid content of the ethyl acetate solution, and the resultant was stirred to thereby form an oil phase. An aqueous phase was prepared by dissolving a dispersant (sorbitol-based surfactant, KOA TW120s, manufactured by Kao Corporation) (2% by mass) in water. While stirring the aqueous phase a homomixer (TK Homomixer MARK II, manufactured by PRIMIX Corporation), the ethyl acetate solution, which was the oil phase, was gradually added to the aqueous phase, to thereby prepare an O/W emulsion having the average particle diameter of 15 μm. The O/W emulsion was stirred for 3 hours (the liquid temperature was 30° C.) to evaporate the excess ethyl acetate, and to this, hydrophobic silica particles were added to thereby form a hydrophobic external additive layer on surfaces of the obtained particles. Thereafter, water was removed, and the particles were sufficiently dried to thereby obtain the dried toner (the average particle diameter: 10 μm). The amount of SBS in the obtained toner was 87% by mass relative to the binder resin.

<Heat Resistance Test>

A heat resistance test was performed by carrying out a measurement by means of a penetration tester (manufactured by Nikka Engineering). Specifically, the toner was weight and sampled by 10 g, the sample toner was placed in a 30 mL glass container (screw vial) in the environment of the temperature ranging from 20° C. to 25° C., and the humidity ranging from 40% RH to 60% RH, and the container was sealed with a lid. The glass contained in which the toner was housed was tapped 100 times, followed by leaving the glass container for 24 hours in a thermostat the temperature of which had been set to 50° C. The toner in the glass container, which had been stood left, was subjected to the measurement of the penetration degree by means of the penetration tester.

[Result]

The penetration degree was 21 mm, which was the excellent result. It was confirmed from this result that the toner of Example 1 had been hardly softened during the storage at 50° C., and the toner of Example 1 had excellent heat resistant storage stability, and resistance to toner-spent, and toner-filming.

<Fixing Test>

Paper (Mypaper, manufactured by Ricoh Company Limited) was provided to give a piece of the paper having sides of 5 cm, and on each piece of the paper, one layer of a toner layer was formed by a cascade developing (i.e., a method where an image is formed by sprinkling the toner on a surface of the paper). The paper on which the toner layer had been formed was passed through the nip having a nip width of 1 mm at the linear velocity of 100 mm/s, where the nip was formed between a metal roller and a metal roller, whose pressing force and roller surface temperatures had been set to the predetermined pressure and temperatures, respectively. After passing through the nip, a surface of the paper on which the toner had been fixed was rubbed with a waste cloth. The degree of the staining of the cloth was measured by means of reflection densitometer to thereby evaluate the fixing ability.

The predetermined pressure was 0.3 MPa and 1.0 MPa.

The predetermined temperatures were 25° C., 40° C., 60° C., 80° C., and 100° C.

Accordingly, the set conditions were ten conditions in total, including two conditions of the pressure, and five conditions of the temperature.

[Results]

The waste cloth was stained at the condition of 0.3 MPa and the toner could not be fixed at any temperature condition, but the toner exhibited excellent fixing ability at 1.0 MPa and 60° C. or higher without staining the waste cloth.

Example 2

Capsules and a toner were obtained in the same manner as in Example 1, provided that the plasticizer for use was changed to paraffin (melting point: 43° C.), the thermoplastic elastomer for use was changed to a ethylene-vinyl acetate-ethylene copolymer (EVA, DQDJ-3868, manufactured by Nippon Unicar Company Limited), 10% by mass of polystyrene was changed to 5% by mass of polybutyl acrylate. An amount of SBS in the toner was 93% by mass relative to the binder resin.

<Heat Resistance Test>

The heat resistance test was performed on the toner of Example 2, in the same manner as in Example 1. As a result, the penetration degree thereof was 21 mm, which was an excellent result. It was confirmed from this result that the toner of Example 2 had been hardly softened during the storage at 50° C., and the toner of Example 2 had excellent heat resistant storage stability, and resistance to toner-spent, and toner-filming.

<Fixing Test>

The fixing test was performed on the toner of Example 2 in the same manner as in Example 1. As a result, the waste cloth was stained at the condition of 0.3 MPa and the toner could not be fixed at any temperature condition, but the toner exhibited excellent fixing ability at 1.0 MPa and 60° C. or higher without staining the waste cloth.

Comparative Example 1

Fixing Test

The fixing test was performed in the same manner as in Example 1, provided that the toner was replaced with a black toner for Ricoh MFP CX3000. As a result, the toner was fixed at the both pressure of 0.3 MPa and 1.0 MPa, and the temperature of 100° C., though there was a slight stain on the waste cloth. At the temperature conditions lower than 100° C., the toner was not fixed and staining was observed on the waste cloth.

Example 3

Preparation of Capsules Each Encapsulating Plasticizer

Capsules each encapsulating lauric acid as a plasticizer and 2,4-dimethoxyacetophenone as a plasticizer and having a shell of polyvinyl alcohol were produced by spray drying. The preparation method is described below.

A beaker was charged with 1,000 mL of water (ion-exchanged water), a dispersant (a sorbitol-based surfactant, KAO TW120s, Kao Corporation) was added thereto in an amount of 1 part by mass relative to 100 parts by mass of the water beaker, and the resulting mixture was stirred to thereby dissolve the dispersant in the water. Thereafter, 1 part by mass of polyvinyl alcohol (Mw=1,400, saponification degree: 99%) powder was added thereto relative to 100 parts by mass of the water and was sufficiently dissolved therein, with maintaining the liquid temperature to 90° C. After dissolving the polyvinyl alcohol powder, powdery lauric acid (manufactured by Kanto Chemical Co., Inc., melting point: 44° C. to 46° C.) and 2,4-dimethoxyacetophenone (manufactured by TOKYO CHEMICAL INDUSTRY CO., LTD., melting point: 42° C.) were added thereto each in an amount of 1 part by mass relative to 100 parts by mass of the water, with maintaining the liquid temperature to 70° C. Thereafter, the aqueous solution in the beaker was stirred by means of an ultrasonic homogenizer (UT-300, manufactured by Nippon Seiki Co., Ltd.) for 10 minutes to thereby obtain an emulsified O/W emulsion. After the stirring, a stirring bar was introduced to the beaker, and the emulsion was continuously stirred at 300 rpm by the stirring bar with maintaining the liquid temperature to 50° C. Thereafter, a commercial product, a spray dry derive (NL-3, manufactured by Ohkawara Kakohki Co., Ltd.), was provided, and the temperature adjacent to a spray gun of a drying tower of the device was set to 80° C., the temperature around the section where the dried particles would be collected was set to 35° C., and the O/W emulsion having the liquid temperature of 50° C. was supplied to the spray gun of the spray dry device by means of a tube pump, via a supplying tube an entire channel of which had been heated to 40° C.

In the manner as mentioned, white powdery particles were obtained in the particle collection section of the spray dry device. The obtained particles were used to produce a sample exposing cross-sections of the particles by means of focused ion beams (FIB), and the obtained sample was observed under a scanning electron microscope (SEM). As a result, the particles were capsules each having a 400 nm-thick shell, and having the average particle diameter of 1 μm. Further, the obtained particles were dispersed in ethanol, and the components in the ethanol were measured by gas chromatography before and after fracturing the capsules by ultrasonic waves. In the ethanol after fracturing the capsules, the components of the plasticizer (lauric acid and 2,4-dimethoxyacetophenone) were detected, and therefore it was confirmed that the components of the plasticizer were encapsulated in capsules.

<Production of Toner>

A styrene-butadiene-styrene copolymer (SBS, ASAPRENE 126S, manufactured by Asahi Kasei Corp.) serving as a thermoplastic elastomer and low molecular polystyrene (HIMER ST120, manufactured by Sanyo Chemical Industries, Ltd.) were added to ethyl acetate in amounts of 9 parts by mass and 1 part by mass respectively, relative to 100 parts by mass of the ethyl acetate, and dissolved therein. To the resultant, 10 parts by mass of carbon black was further added, the resulting mixture was milled by a ball mill, to thereby disperse the pigment in the resin solution. Next, 60 parts by mass of the obtained resin solution, 20 parts by mass of hexane, and 1 part by mass of the above-prepared capsules each encapsulating the plasticizer were mixed together. This series of the mixing operations were performed in the environment of 20° C. The mixed solution in which the SBS and the capsules were mixed was used as an oil phase.

Meanwhile, 1 part by mass of a dispersant (sorbitol-based surfactant, KAO TW120s, manufactured by Kao Corporation) was dissolved in 100 parts by mass of water to thereby prepare an aqueous phase. While stirring 100 parts by mass of the aqueous phase a homomixer (TK Homomixer MARK II, manufactured by PRIMIX Corporation), 10 parts by mass of the mixed solution, which was the oil phase, was gradually added, to thereby prepare an O/W emulsion having the average particle diameter of 20 μm. To this O/W emulsion, hydrophobic silica particles were added, followed by stirring for 10 minutes (the liquid temperature was 30° C.), while forming a hydrophobic external additive layer on surfaces of the obtained particles. Thereafter, the O/W emulsion was poured to a flask of a rotary evaporator, and nitrogen gas was blown into the flask while rotating the flask with maintaining the liquid temperature to 30° C., to thereby evaporate ethyl acetate and hexane. The resultant was then subjected to vacuum filtration to remove water and the excess dispersant, followed by sufficiently drying, to thereby obtain the dried toner (the average particle diameter: 15 μm). The mass ratio (SBS:polystyrene) of SBS to the polystyrene was 90:10 on the basis of the charging amounts. Moreover, the amount of the capsules each encapsulating the plasticizer was 20% by mass relative to the mixed resin of SBS and the polystyrene.

A sample including the cross-sections of the toner particles was prepared from the obtained toner by FIB. The cross-sections of the toner particles were observed under SEM, and as a result, it was found that there were 10 to 15 capsules having the diameters of 1 μm in each toner particle having the diameter of 15 μm.

<Heat Resistance Test>

The heat resistance test was performed on the toner of Example 3, in the same manner as in Example 1. As a result, the penetration degree thereof was 21 mm, which was an excellent result. It was confirmed from this result that the toner of Example 3 had been hardly softened during the storage at 50° C., and the toner of Example 3 had excellent heat resistant storage stability, and resistance to toner-spent, and toner-filming.

<Fixing Test>

The fixing test was performed on the toner of Example 3 in the same manner as in Example 1. As a result, the waste cloth was stained at the condition of 0.3 MPa and the toner could not be fixed at any temperature condition, but the toner exhibited excellent fixing ability at 1.0 MPa and 60° C. or higher without staining the waste cloth.

<Developing Stress Test>

A developing unit mounted in a commercial product, MFP (Imagio MPC3000, of Ricoh Company Limited) was charged with the toner of Example 3 as well as magnetic carrier particles, and the toner and the carrier particles were mixed. Then, the developing unit was continuously operated for 30 minutes. After this running test, the surface temperature of the developing sleeve roller was 40° C. After the running test, the magnetic carrier particles on the developing sleeve were removed with a magnet, and the toner on the developing sleeve was removed by a vacuum cleaner. Thereafter, a surface of the sleeve roller was observed and confirmed that there was no toner-spent, or toner-filming occurred on the sleeve. The toner collected by the vacuum cleaner was moreover observed, and as a result, there was no deformation or aggregation in the toner particles.

It was found from the results above that the toner of the present invention could be fixed at the pressing force of 1.0 MPa and the temperature of 60° C. (roller surface temperature), which was lower than the fixing temperature of conventional commercial toners by 40° C. The toner of the present invention was moreover excellent in heat resistant storage stability, and resistance to toner-spent and toner-filming.

Embodiments of the present invention are as follows:

<1> A toner containing:

a binder resin;

a colorant; and capsules, wherein the binder resin contains a thermoplastic elastomer, and wherein the capsules each encapsulate a plasticizer capable of softening the thermoplastic elastomer and the capsules are fractured upon application of predetermined pressure.

<2> The toner according to <1>, wherein the plasticizer is a solid at ordinary temperature.

<3> The toner according to any of <1> or <2>, wherein the plasticizer contains lauric acid.

<4> The toner according to any of <1> or <2>, wherein the plasticizer contains n-alkane that is a solid at ordinary temperature.

<5> The toner according to any one of <1> to <4>, wherein the thermoplastic elastomer contains a hard segment and a soft segment.

<6> The toner according to any one of <1> to <3>, wherein the thermoplastic elastomer contains a styrene-butadiene-styrene copolymer.

<7> The toner according to any one of <1>, <2>, or <4>, wherein the thermoplastic elastomer contains an ethylene-vinyl acetate-ethylene copolymer.

<8> The toner according to <1>, wherein the plasticizer contains lauric acid, and the thermoplastic elastomer contains a styrene-butadiene-styrene copolymer.

<9> The toner according to <1>, wherein the plasticizer contains n-alkane that is a solid at ordinary temperature, and the thermoplastic elastomer contains an ethylene-vinyl acetate-ethylene copolymer.

<10> A developer containing the toner as defined in any one of <1> to <9>.

<11> A toner container containing:

a container; and a toner housed in the container, where the toner is the toner as defined in any one of <1> to <9>.

<12> An image forming apparatus, containing:

a latent electrostatic image bearing member;

a latent electrostatic image forming unit configured to form a latent electrostatic image on the latent electrostatic image bearing member;

a developing unit configured to develop the latent electrostatic image with a toner to form a visible image;

a transferring unit configured to transfer the visible image onto a recording medium; and a fixing unit configured to fix the visible image transferred on the recording medium, wherein the toner is the toner as defined in any one of <1> to <9>.

<13> An image forming method, containing:

forming a latent electrostatic image on a latent electrostatic image bearing member;

developing the latent electrostatic image with a toner to form a visible image;

transferring the visible image onto a recording medium; and fixing the visible image transferred onto the recording medium, wherein the toner is the toner as defined in any one of <1> to <9>.

<14> A process cartridge containing:

a latent electrostatic image bearing member; and a developing unit configured to develop a latent electrostatic image, which has been formed on the latent electrostatic image bearing member, with a toner to form a visible image, wherein the toner is the toner as defined in any one of <1> to <9>.

What is claimed is:

1. A toner, comprising:

a binder resin;

a colorant; and capsules, wherein the binder resin contains a thermoplastic elastomer, wherein the capsules each encapsulate a plasticizer capable of softening the thermoplastic elastomer and the capsules are fractured upon application of predetermined pressure, and wherein an amount of the thermoplastic elastomer is 50% by mass to 95% by mass relative to the binder resin.

2. The toner according to claim 1, wherein the thermoplastic elastomer contains a hard segment and a soft segment.

3. A developer containing the toner as defined in claim 1.

4. A toner container, comprising:

a container; and a toner housed in the container, where the toner is the toner as defined in claim 1.

5. An image forming apparatus, comprising:

a latent electrostatic image bearing member;

a latent electrostatic image forming unit configured to form a latent electrostatic image on the latent electrostatic image bearing member;

a developing unit, which contains a toner and is configured to develop the latent electrostatic image with the toner to form a visible image;

a transferring unit configured to transfer the visible image onto a recording medium; and a fixing unit configured to fix the visible image transferred on the recording medium, wherein the toner is the toner as defined in claim 1.

6. A process cartridge, comprising:

a latent electrostatic image bearing member; and a developing unit, which contains a toner, and is configured to develop a latent electrostatic image, which has been formed on the latent electrostatic image bearing member, with the toner to form a visible image, wherein the toner is the toner as defined in claim 1.

* * * * *